US011844987B1

(12) United States Patent
Pegnatori

(10) Patent No.: US 11,844,987 B1
(45) Date of Patent: Dec. 19, 2023

(54) BASEBALL BAT HAVING AN INNER BARREL TECHNOLOGY INSERT

(71) Applicant: Carl Pegnatori, Calimesa, CA (US)

(72) Inventor: Carl Pegnatori, Calimesa, CA (US)

( * ) Notice: Subject to any disclaimer, the term of this patent is extended or adjusted under 35 U.S.C. 154(b) by 263 days.

(21) Appl. No.: 16/745,321

(22) Filed: Jan. 16, 2020

Related U.S. Application Data

(60) Provisional application No. 62/793,329, filed on Jan. 16, 2019.

(51) Int. Cl.
*A63B 59/58* (2015.01)
*A63B 102/18* (2015.01)

(52) U.S. Cl.
CPC ..... *A63B 59/58* (2015.10); *A63B 2102/18* (2015.10)

(58) Field of Classification Search
CPC ..... A63B 59/50; A63B 59/51; A63B 59/52; A63B 59/54; A63B 59/58; A63B 2102/18
USPC ..... 446/564, 566, 567; 473/564, 566, 567
See application file for complete search history.

(56) References Cited

U.S. PATENT DOCUMENTS 5,676,610 A * 10/1997 Bhatt ..... A63B 59/50 473/566
6,042,493 A * 3/2000 Chauvin ..... A63B 59/51 473/566
6,146,291 A * 11/2000 Nydigger ..... A63B 59/56 473/566
6,176,795 B1 * 1/2001 Schullstrom ..... A63B 59/50 473/566
6,663,517 B2 * 12/2003 Buiatti ..... A63B 60/54 473/566
7,361,106 B1 * 4/2008 Vacek ..... A63B 59/50 473/566
7,850,554 B2 * 12/2010 Burger ..... A63B 59/50 473/567
7,874,946 B2 * 1/2011 Smith ..... A63B 60/54 473/567
7,980,970 B2 * 7/2011 Watari ..... A63B 59/50 473/566
8,435,143 B2 * 5/2013 Vander Pol ..... A63B 60/00 473/566
9,005,056 B2 * 4/2015 Pegnatori ..... A63B 60/00 473/564
9,101,810 B2 * 8/2015 Carlson ..... A63B 60/42
9,486,680 B2 * 11/2016 Burger ..... A63B 60/42
10,029,162 B2 * 7/2018 Chauvin ..... A63B 60/54
10,220,277 B1 * 3/2019 Hunt ..... A63B 1/00
(Continued)

*Primary Examiner* — Joseph B Baldori
(74) *Attorney, Agent, or Firm* — David B Abel

(57) ABSTRACT

A bat having a tubular frame having a circular cross-section, the tubular frame including a large diameter hitting portion, an intermediate tapering portion, and a small diameter handle portion for a user, the tubular frame has a hollow barrel in the large diameter hitting portion, one or more inner barrel inserts positioned within the large diameter hitting portion, the inner barrel inserts each having first and second ends, the inner barrel inserts each have a vertical gap along the length of the entire inner barrel insert, which forms a "C" when viewing the cross section of the inner barrel insert, which is positioned in the hitting portion to enhance the spring effect as well as enhance the durability of the inner barrel insert, the inner barrel insert being secured within said hitting portion, and a cap covering an exposed end of the hitting portion. Wherein said inner barrel insert is relatively convex in shape.

13 Claims, 16 Drawing Sheets

(56) References Cited

U.S. PATENT DOCUMENTS

| | | | | |
|---|---|---|---|---|
| 10,265,595 | B1 * | 4/2019 | Stenzler | A63B 60/42 |
| 10,646,761 | B2 * | 5/2020 | Early | A63B 59/50 |
| 11,097,171 | B2 * | 8/2021 | Pegnatori | A63B 59/58 |
| 2001/0021678 | A1 * | 9/2001 | Pitsenberger | A63B 59/51 473/564 |
| 2004/0053716 | A1 * | 3/2004 | Wu | A63B 59/50 473/564 |
| 2006/0019779 | A1 * | 1/2006 | Fritzke | A63B 60/06 473/567 |
| 2011/0275458 | A1 * | 11/2011 | Estrada, Jr. | A63B 59/50 473/437 |
| 2012/0184402 | A1 * | 7/2012 | McNamee | A63B 60/54 473/520 |
| 2015/0190692 | A1 * | 7/2015 | Fitzgerald | A63B 59/50 473/564 |
| 2020/0330838 | A1 * | 10/2020 | Goodwin | A63B 59/56 |

* cited by examiner

BASEBALL BAT HAVING AN INNER BARREL TECHNOLOGY INSERT

CROSS-REFERENCE TO RELATED APPLICATIONS

The present application claims priority under 35 U.S.C. 119(e) and under all applicable U.S. statutes and regulations, to U.S. Provisional Application Ser. No. 62/793,329. The disclosure of which is hereby incorporated herein by reference in its entirety.

BACKGROUND OF THE INVENTION

Field of the Invention

The present invention is generally related to the field of baseball and softball and more specifically to one or more inner barrel inserts for a baseball or softball bat thereby providing an enhanced spring effect that is more durable.

Description of the Related Art

High performance baseball and softball bats, hereinafter referred to simply as "softball bats", "baseball bats" or "bats", are primarily made from aluminum alloys as well as titanium, plastic, rubber, steel, carbon fiber, composite materials, or some combination thereof. These bats are tubular (hollow inside) so as to optimize their weight and they consist of three sections: a relatively narrow handle portion for gripping, a relatively wider distal portion for hitting, and a tapered mid-section connecting the handle and hitting portions.

Original aluminum bats were fabricated as a single piece in that they solely consisted of a frame with nothing occupying the space within the frame. It was found that these bats outperformed traditional wooden bats because of a "rebound" effect present in aluminum/composite bats. As the ball impacted the bat, the bat wall would absorb the energy from the impact by elastically deforming the wall at the point of impact. As the ball began to leave the bat the energy absorbed by the elastic deformation would be released by the wall returning to its original structure, in effect giving the ball an extra "push", thus the rebound effect. Another name given to this effect is the "trampoline" or "spring effect".

Manufacturers of bats found that by making the wall thinner the rebound effect would be magnified. However thinner walls also decreased the life of the bat as the wall would fatigue and no longer return to its original position; leaving dents or dings on the bat. As a result manufacturers begin to look at ways of utilizing the cavity within the hitting portion of the bat to increase the rebound effect and reduce fatigue.

Currently most performance bats will start to experience fatigue within the hitting portion of the bat in as little as fifty (50) hits. Most standard bats are only good for approximately 500 hits or so before fatigue sets in. As such, there is a need in the art for a new device that will still provide an enhanced spring effect and most importantly provide durability to the use of the bat.

As such, there is a need in the art for a new device that will provide an enhanced spring effect and durability through the use of inner barrel insert technology without decreased the life of the bat.

As such, there is a need in the art for a new device that will provide an enhanced spring effect and durability through the use of inner barrel technology without incurring wall fatigue.

Modern traditional bat seeking to provide greater trampoline effect by utilizing and inserting a circular barrel insert positioned in the hitting area to enhance the trampoline effect.

The circular barrel or similar solid shape barrel inserts have been made of various composite materials. Additionally, some of the inserts have been made of various composite materials that have formed one of more layers of fibers embedded in a matrix. The composite material bats allow for the most design flexibility and customization. In other words, longitudinal stiffness, moment of inertia, mass, and center of gravity may be more precisely controlled using such design factors as type of matrix material, type and modulus of the fibers, orientation of the fibers, and number of layers or thickness of the composite.

However, there is a need in the art for a new device that will provide an enhanced spring effect and durability through the use of inner barrel insert technology that does not have a circular barrel or similar solid shape barrel insert.

Additionally, there is a need in the art for a new device that will provide an enhanced spring effect and durability through the use of a convex inner barrel insert design to further enhance the spring effect as well as enhances the durability of the inner barrel insert and prevents bat fatigue.

There is also need in the art for a new device that will provide an enhanced spring effect and durability through the use of a convex inner barrel insert having a vertical gap along the length of the barrel insert, which forms a "C", which is positioned in the hitting area to enhance the spring effect and enhances the durability of the inner barrel insert and prevents bat fatigue.

Further, there is a need in the art for a new device that will provide an enhanced spring effect and durability through the use of a convex inner barrel insert, which forms a "C", that is positioned in the hitting area to enhance the spring effect and enhances the durability of the inner barrel insert and prevents bat fatigue.

Furthermore, there is a need in the art for a new device that will provide an enhanced spring effect and durability through the use of a convex inner barrel insert having a vertical gap along the length of the barrel insert, which forms a "C", which is positioned in the hitting area to enhance the spring effect and durability of the bat, wherein the inner barrel insert does not come into contact with the inside wall of the bat when the bat is at rest, yet when swung the inner barrel is allowed to move so as to amplify the rebound effect given to the ball upon impact with the bat.

Additionally in an alternative embodiment, there is a need in the art for a new device that will provide an enhanced spring effect and durability through the use of one or more layers of the inner barrel technology that does not have: a circular, cylinder, hexagon, rectangular or similar barrel insert and instead is designed so that there is a vertical gap along the length of the barrel insert, which forms a "C", to further enhance the spring effect as well as enhances the durability of the inner barrel insert and prevents bat fatigue.

Further, there is a need in the art for a new device that will provide an enhanced spring effect and durability through the use of inner barrel insert, which is in the form of a "C" when viewing the cross section of the inner barrel insert, and which is positioned in the hitting area to enhance the spring effect and enhances the durability of the inner barrel insert and prevents bat fatigue.

Furthermore in an alternative embodiment, there is a need in the art for a new device that will provide an enhanced spring effect and durability through the use of one or more layers of the inner barrel insert, which is in the form of a "C" when viewing the cross section of the inner barrel, and which is positioned in the hitting area to enhance the spring effect and enhances the durability of the inner barrel insert and prevents bat fatigue.

Additionally, there is a need in the art for a new spring loaded inner barrel insert that is placed inside the barrel of the bat in such a manner that it is spring loaded so that when the ball hits the barrel, it causes greater trampoline effect and also provides unmatched durability, wherein the inner barrel insert is not a complete circle and wherein the inner barrel insert has a vertical gap, which forms a "C" when viewing the cross section of the inner barrel insert, and wherein the inner barrel insert is positioned in the hitting area to enhance the trampoline effect and enhances the durability of the inner barrel insert and prevents bat fatigue.

Lastly, there is a need in the art for a new spring loaded inner barrel insert that is placed inside the barrel of the bat in such a manner that it is spring loaded so that when the ball hits the barrel, it causes greater trampoline effect and also provides unmatched durability, wherein the inner barrel insert is in the form of a "C" when viewing the cross section of the inner barrel insert, and wherein the inner barrel insert is positioned in the hitting area to enhance the trampoline effect.

The prior art designs presented herein provide for a less than optimal rebound effect by means of the multiple points of contact between the walls and the multiple points of contact allow vibrations to spread throughout the bat.

BRIEF SUMMARY OF THE INVENTION

The primary purpose of this invention is to provide performance, durability, and reliability to baseball/softball bats. It is also the object of this invention to allow a bat to remain in a compressed state to provide a trampoline effect for the life of the bat, which would solve a huge problem in the bat industry since most bats are only good for approximately 500 hits or so before fatigue sets in.

It is an object of this invention to solve the aforementioned problems, by creating a spring like inner barrel insert that will provide an enhanced trampoline effect and also provide a breakthrough in the durability and reliability of these type of performance bats.

It is also object of this invention to create a bat that provides greater trampoline effect by creating a spring like inner barrel insert positioned in the hitting area to enhance the trampoline effect, wherein the inner barrel insert is not a complete circle and the inner barrel insert has a gap.

It is an object of this invention to create a bat that provides greater durability by creating an inner barrel insert positioned in the hitting area, wherein the inner barrel insert is not a complete circle and has a vertical gap positioned along the length of the barrel insert, thereby providing unmatched durability and reliability for both the inner barrel insert as well as the bat.

It is another object of this invention to create a bat that provides greater trampoline effect by having a spring like inner barrel insert that has one or more layers that are not secured with each other so that each layer may fully flex independently of any adjacent layer to enhance the rebound effect and damping vibrations, wherein the inner barrel insert is not a complete circle and in wherein the inner barrel insert has a gap and wherein the inner barrel insert is positioned in the hitting area to enhance the trampoline effect.

It is still yet another object of this invention to create a bat having a new spring loaded inner barrel insert that is placed inside the barrel of the bat in such a manner that it is spring loaded so that when the ball hits the barrel, it causes greater trampoline effect and also provides unmatched durability, wherein the inner barrel insert is not a complete circle and the inner barrel insert has a gap and wherein the inner barrel insert is positioned in the hitting area to enhance the trampoline effect.

It is also object of this invention to create a bat that provides greater trampoline effect by creating a spring like inner barrel insert in the form of a "C" when viewing the cross section of the inner barrel insert, and inner barrel insert is positioned in the hitting area to enhance the trampoline effect.

It is another object of this invention to create a bat that will provide an enhanced spring effect and durability through the use of a convex inner barrel insert design to further enhance the spring effect as well as enhances the durability of the inner barrel insert and prevents bat fatigue.

It is an object of this invention to create a bat that will provide an enhanced spring effect and durability through the use of a convex inner barrel insert design, wherein the convex outer shape provides an enhance spring effect.

It is an object of this invention to create a bat that will provide an enhanced spring effect and durability through the use of a convex inner barrel insert design, wherein the convex inner shape provides an enhance spring effect.

It is an object of this invention to create a bat that will provide an enhanced spring effect and durability through the use of a convex inner barrel insert design, wherein the convex barrel has a hallow chamber that provides an enhance spring effect.

It is still yet another object of this invention to create a bat that will provide an enhanced spring effect through the use of a convex inner barrel insert having a vertical gap along the length of the barrel insert, which forms a "C", which is positioned in the hitting area to enhance the spring effect, when the ball comes into contact with the bat.

It is also an object of this invention to create a bat that provides greater durability by creating a convex inner barrel insert having a vertical gap along the length of the barrel insert, which forms a "C", which is positioned in the hitting area to providing unmatched durability for both the inner barrel insert as well as the bat.

It is another object of this invention to create a bat that will provide an enhanced spring effect and durability through the use of a convex inner barrel insert, which forms a C, that is positioned in the hitting area to enhance the spring effect as well as enhances the durability of the inner barrel insert and prevents bat fatigue.

It an object of this invention to create a bat that will provide an enhanced spring effect and durability through the use of a convex inner barrel insert having a vertical gap along the length of the barrel insert, which forms a "C", which is positioned in the hitting area to enhance the spring effect and durability of the bat, wherein the inner barrel insert does not come into contact with the inside wall of the bat when the bat is at rest, yet when swung the inner barrel insert is allowed to move so as to amplify the rebound effect given to the ball upon impact with the bat.

It is an object of this invention in one embodiment to create a bat, wherein the convex inner barrel insert does not come into contact with the inside wall of the bat when the bat is at rest, yet when swung the inner barrel is allowed to move so as to amplify the rebound effect given to the ball upon impact with the bat through the use of one or more pieces of foam to separate said inner barrel insert from the inside wall of the bat.

It is another object of this invention to create a bat that provides greater trampoline effect by having a spring like inner barrel that has one or more layers that are not secured with each other so that each layer may fully flex independently of any adjacent layer to enhance the rebound effect and damping vibrations, wherein the inner barrel insert in the form of a "C" that is positioned in the hitting area to enhance the trampoline effect.

It is still yet another object of this invention to create a bat having a new spring loaded inner barrel insert that is placed inside the barrel of the bat in such a manner that it is spring loaded so that when the ball hits the barrel, it causes greater trampoline effect and also provides unmatched durability, wherein the inner barrel insert is in the form of a "C" and wherein the inner barrel insert is positioned in the hitting area to enhance the trampoline effect.

In view of the foregoing, it is an object of the present invention to provide a bat that incorporates an inner barrel wall(s) that are not secured with each other so that each wall may fully flex independently of any adjacent wall to enhance the rebound effect and damping vibrations.

It is another object of this invention to create a bat having a new spring loaded inner barrel insert that is placed inside the barrel of the bat in such a manner that it is spring loaded so that when the ball hits the barrel it causes greater trampoline effect.

It is another object of the present invention to create a bat having an inner barrel insert that has a multilayer design that may be easily manufactured.

It is an object of this invention to create a bat having an inner barrel insert that is easy to manufacture, reliable in operation, and relatively inexpensive to produce.

In addition to the above objects, various other objects of this invention will be apparent from careful reading of this specification including the detailed description contained herein below.

BRIEF DESCRIPTION OF DRAWINGS

These as well as other features of the present invention will become more apparent upon reference to the accompanying drawings wherein like numerals designate corresponding parts in the several figures summarized as follows.

Other features and advantages of the invention will be become apparent from the following detailed description, taken in conjunction with the accompany drawings, which illustrate, by way of example, various features of the invention.

DETAILED DESCRIPTION OF THE INVENTION

The following detailed description and accompanying drawings are provided for purposes of illustrating and describing presently preferred embodiments of the present invention and are not intended to limit the scope of the invention in anyway. It will be understood that various changes in the details, materials, arrangements of parts or operational conditions which have been herein described and illustrated in order to explain the nature of the invention may be made by those skilled in the art within the principles and the scope of the invention.

Figure 1:
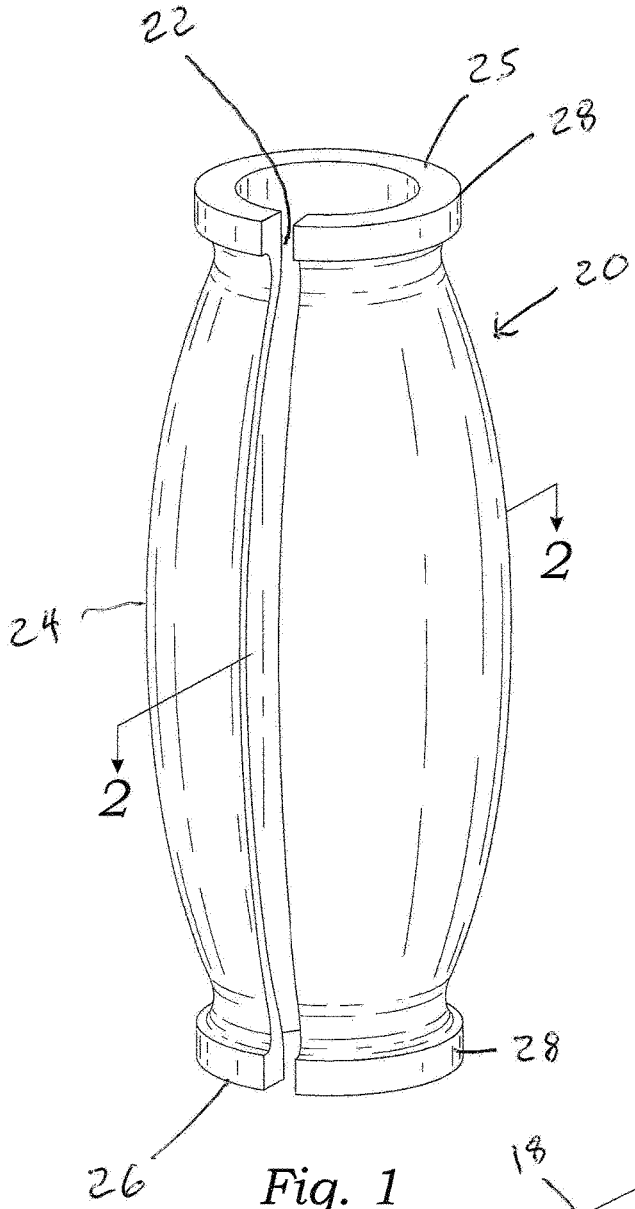
FIG. 1 shows a perspective view of the preferred embodiment of the invention showing an inner barrel insert that is convex in shape.
Figure 2:
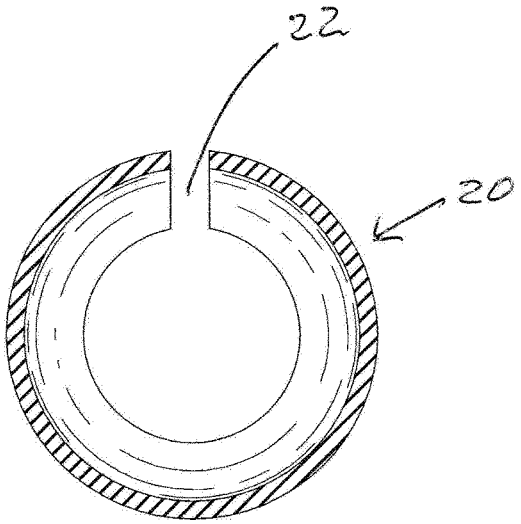
FIG. 2 shows a cross sectional view of an inner barrel insert having a vertical gap along the length of the entire inner barrel insert, which forms a "C" when viewing the cross section of the inner barrel insert.
Figure 3:
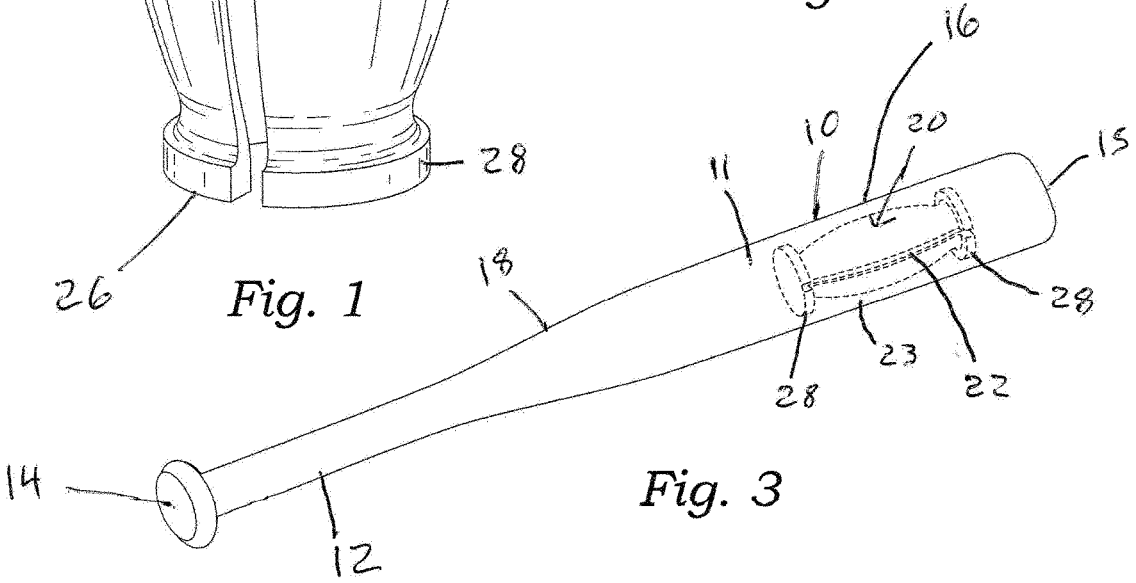
FIG. 3 shows a perspective view of the preferred embodiment of the invention, a bat having one or more inner barrel inserts positioned within the large diameter hitting portion, the inserts each having first and second ends, the inserts each have a vertical gap along the length of the entire inner barrel insert, which forms a "C" when viewing the cross section of the inner barrel insert, which is positioned in the hitting portion to enhance the spring effect as well as enhance the durability of the inner barrel insert.
Figure 4:
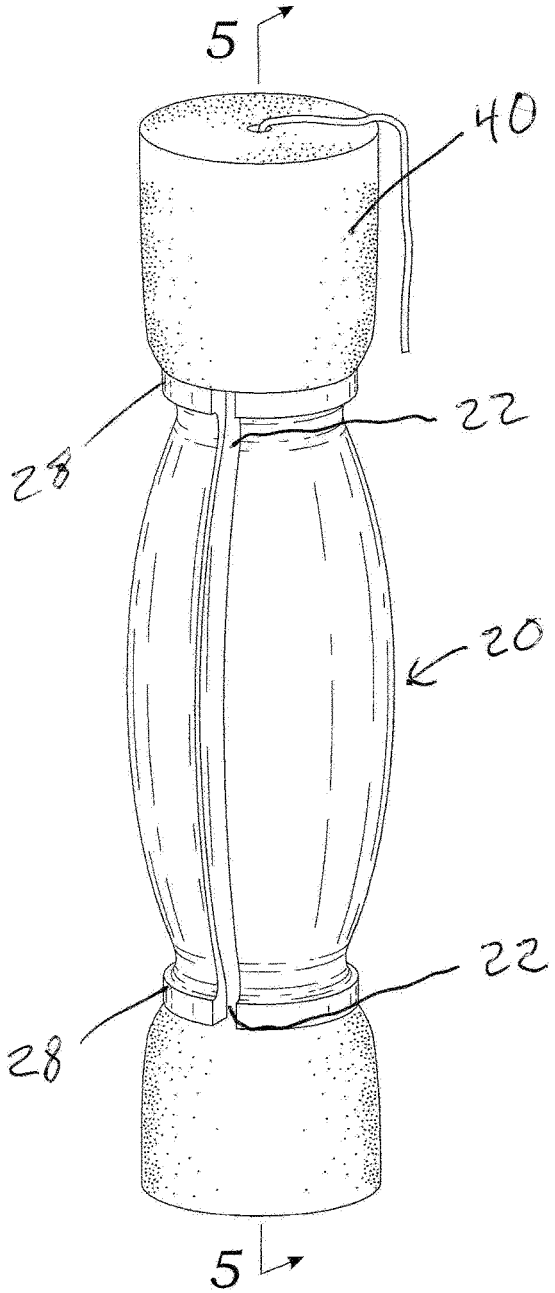
FIG. 4 shows a perspective view of the preferred embodiment of the invention showing an inner barrel insert having foam on both ends of said insert.
Figure 5:
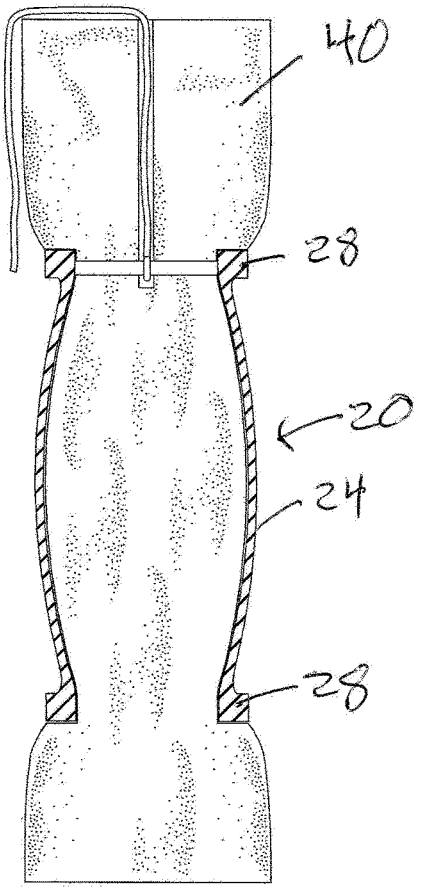
FIG. 5 shows a sectional view of the preferred embodiment of the invention showing an inner barrel insert having foam in and on both ends of said insert.
Figure 6:
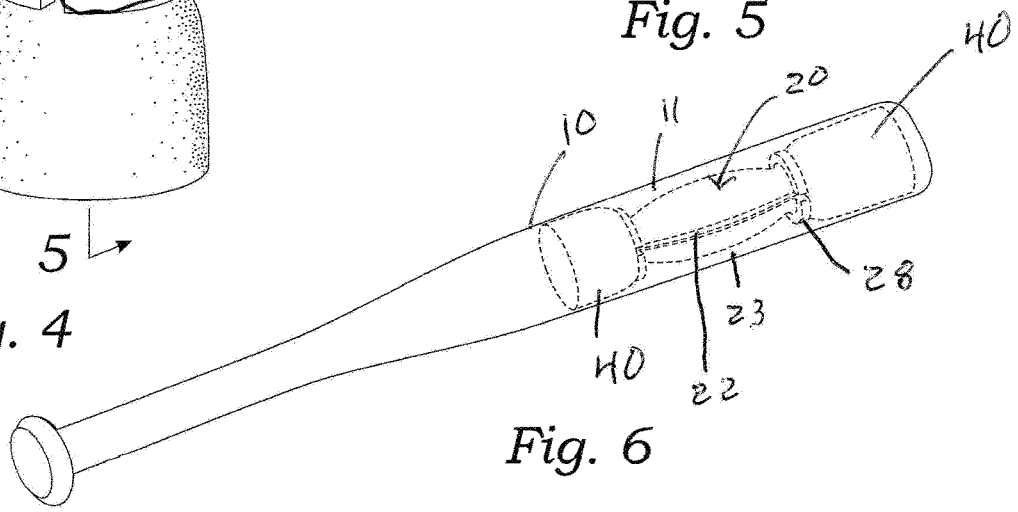
FIG. 6 shows a perspective view of the preferred embodiment of the invention, a bat having one or more inner barrel inserts convex in shape positioned within the large diameter hitting portion, the inserts each having first and second ends, the inserts each have a vertical gap along the length of the entire inner barrel insert, which forms a "C" when viewing the cross section of the inner barrel insert, which is positioned in the hitting portion to enhance the spring effect as well as enhance the durability of the inner barrel insert.
Figure 7:
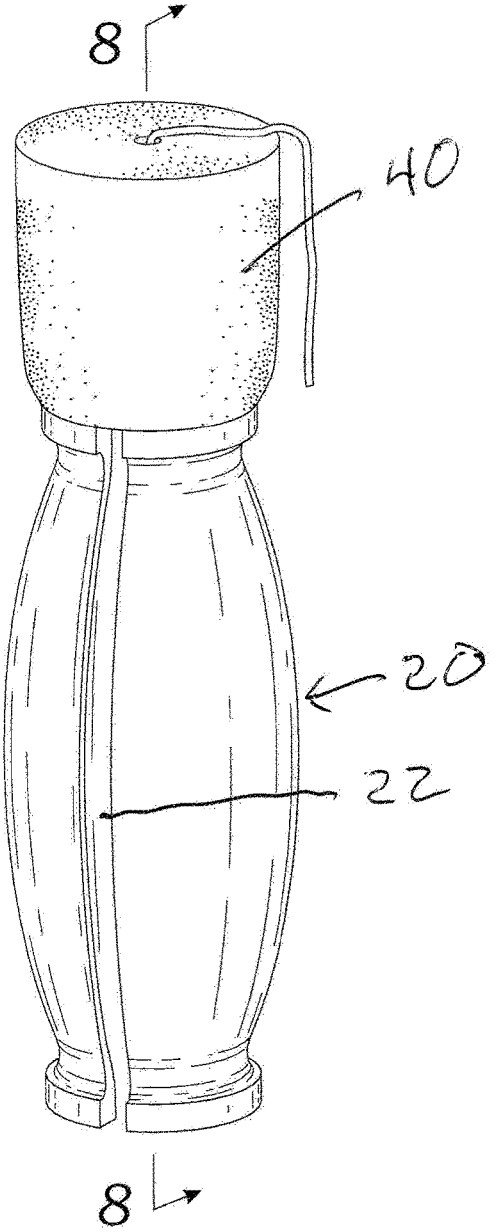
FIG. 7 shows a perspective view of an alternative embodiment of the invention showing an inner barrel insert convex in shape having foam on one end of said insert.
Figure 8:
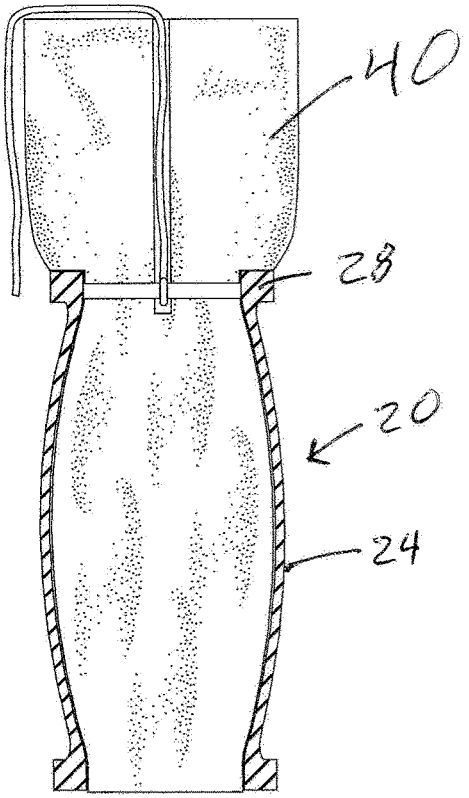
FIG. 8 shows a sectional view of an inner barrel insert having a vertical gap along the length of the entire inner barrel insert, which forms a "C" when viewing the cross section of the inner barrel insert having foam in and on one end of said insert.
Figure 9:
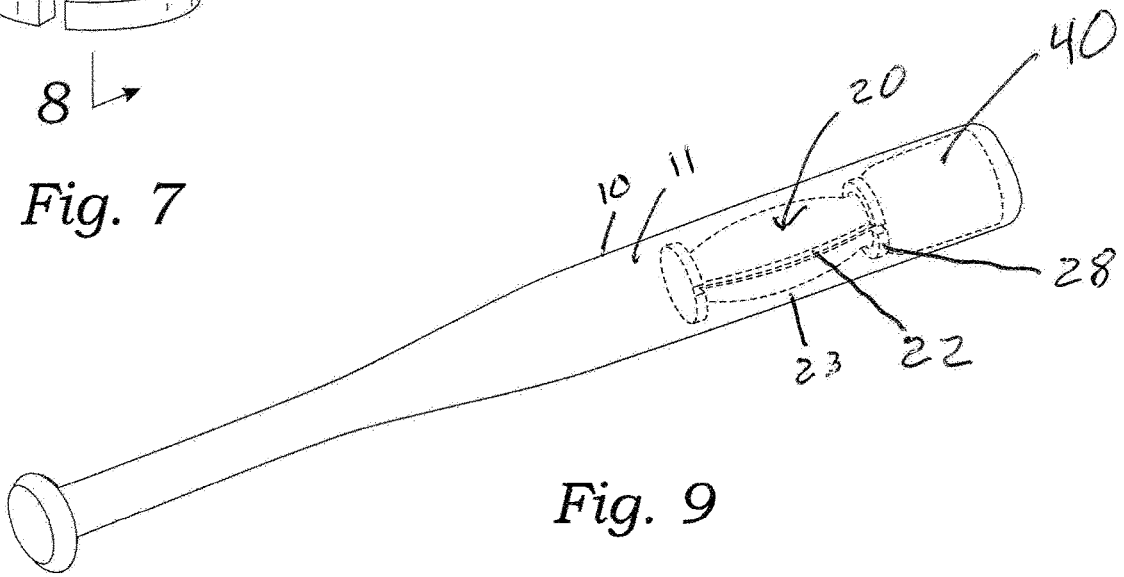
FIG. 9 shows a perspective view of the invention, a bat having one or more inner barrel inserts positioned within the large diameter hitting portion, the inserts each having first and second ends, the inserts each have a vertical gap along the length of the entire inner barrel insert, which forms a "C" when viewing the cross section of the inner barrel insert, which is positioned in the hitting portion to enhance the spring effect as well as enhance the durability of the inner barrel insert.
Figure 10:
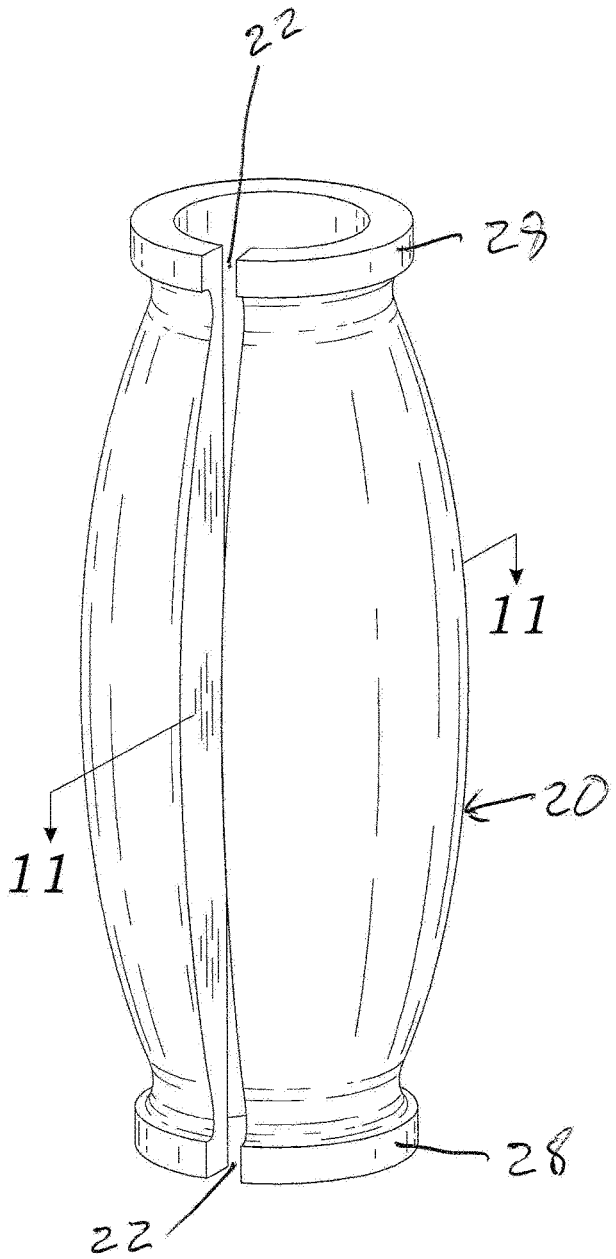
FIG. 10 shows a perspective view of an alternative embodiment of the invention showing an inner barrel insert in a convex shape.
Figure 11:
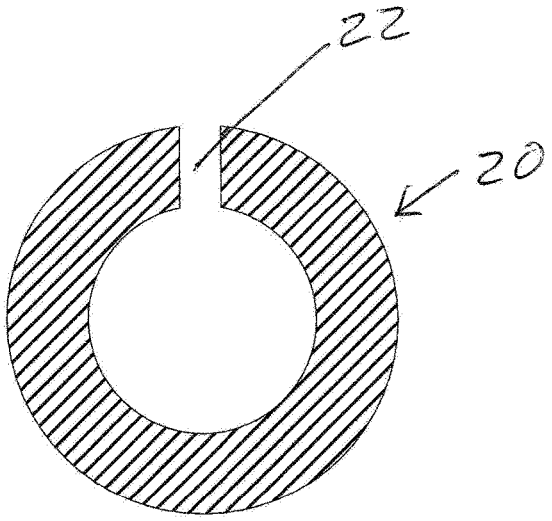
FIG. 11 shows a cross sectional view of an inner barrel insert having a vertical gap along the length of the entire inner barrel insert, which forms a "C" when viewing the cross section of the inner barrel insert.
Figure 12:
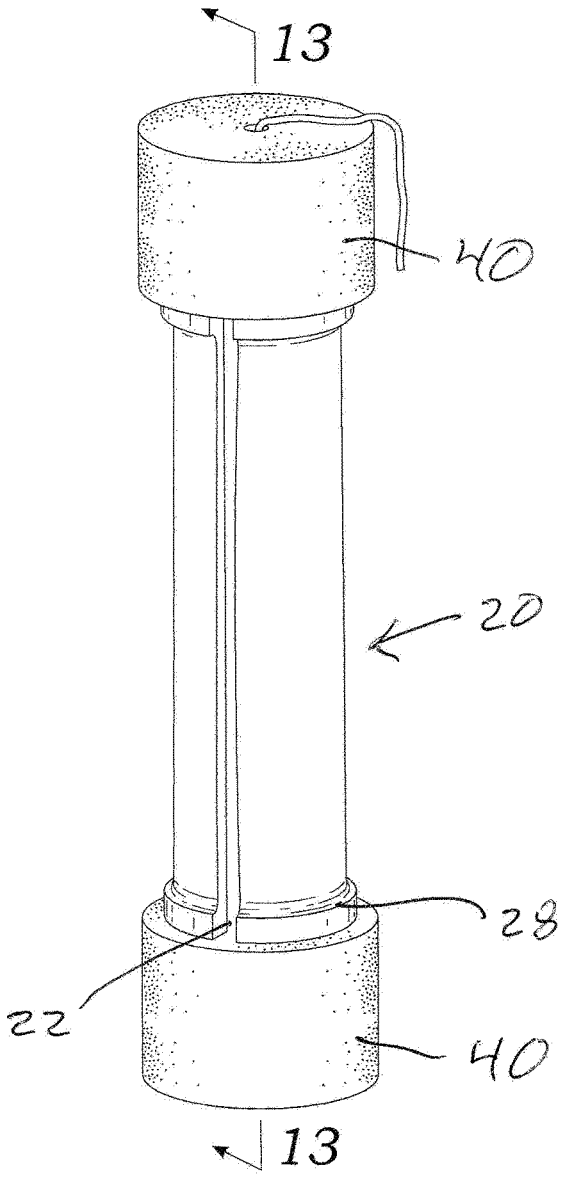
FIG. 12 shows a perspective view of an alternative embodiment of the invention showing an inner barrel insert rectangular in shape having foam on said ends of said insert.
Figure 13:
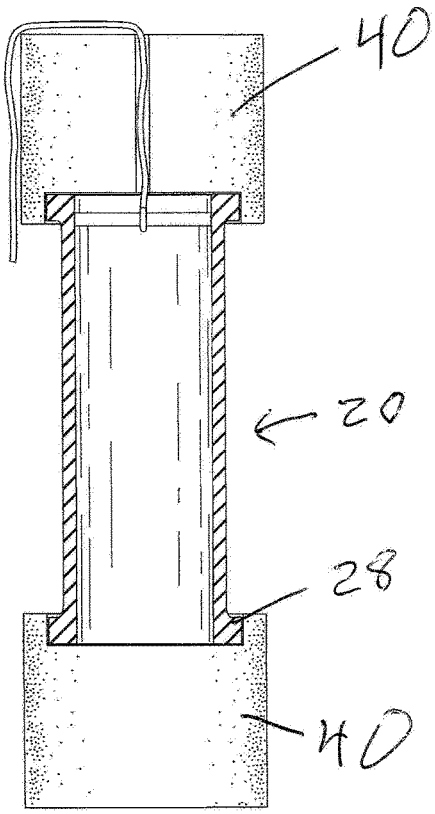
FIG. 13 shows a cross sectional view of an inner barrel insert rectangular in shape having a vertical gap along the length of the entire inner barrel insert, which forms a "C" when viewing the cross section of the inner barrel insert.
Figure 14:
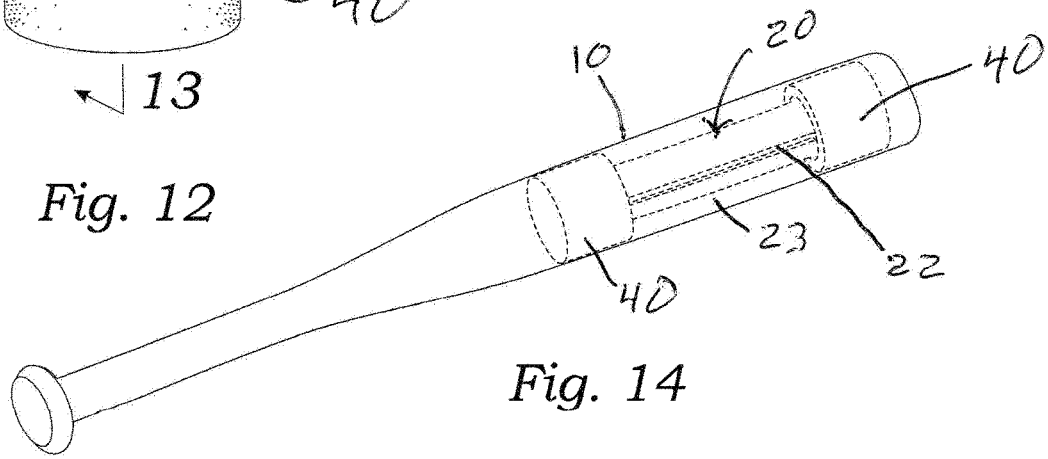
FIG. 14 shows a perspective view of the invention, a bat having one or more inner barrel inserts rectangular in shape positioned within the large diameter hitting portion, the inserts each having first and second ends, the inserts each have a vertical gap along the length of the entire inner barrel insert, which forms a "C" when viewing the cross section of the inner barrel insert, which is positioned in the hitting portion to enhance the spring effect as well as enhance the durability of the inner barrel insert having foam on said ends of said insert.
Figure 15:
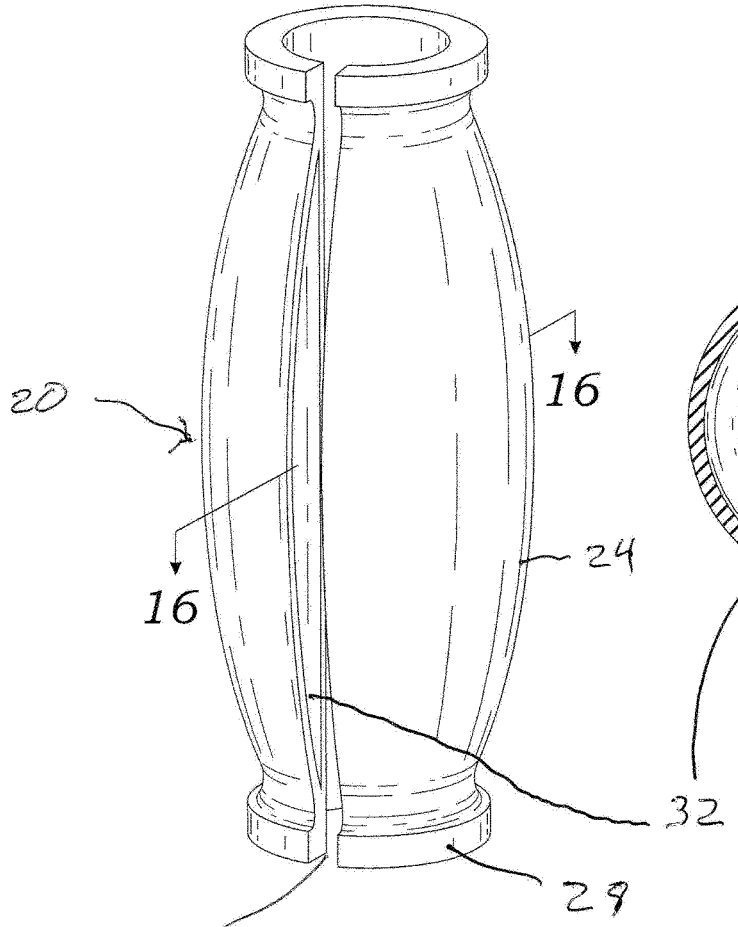
FIG. 15 shows a perspective view of an alternative embodiment of the invention showing an inner barrel insert having a hallow chamber within said insert.
Figure 16:
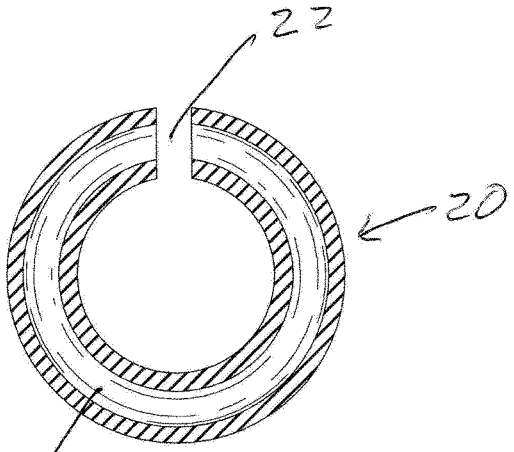
FIG. 16 shows a cross sectional view of an alternative embodiment of the invention showing an inner barrel insert having a hallow chamber within said insert.
Figure 17:
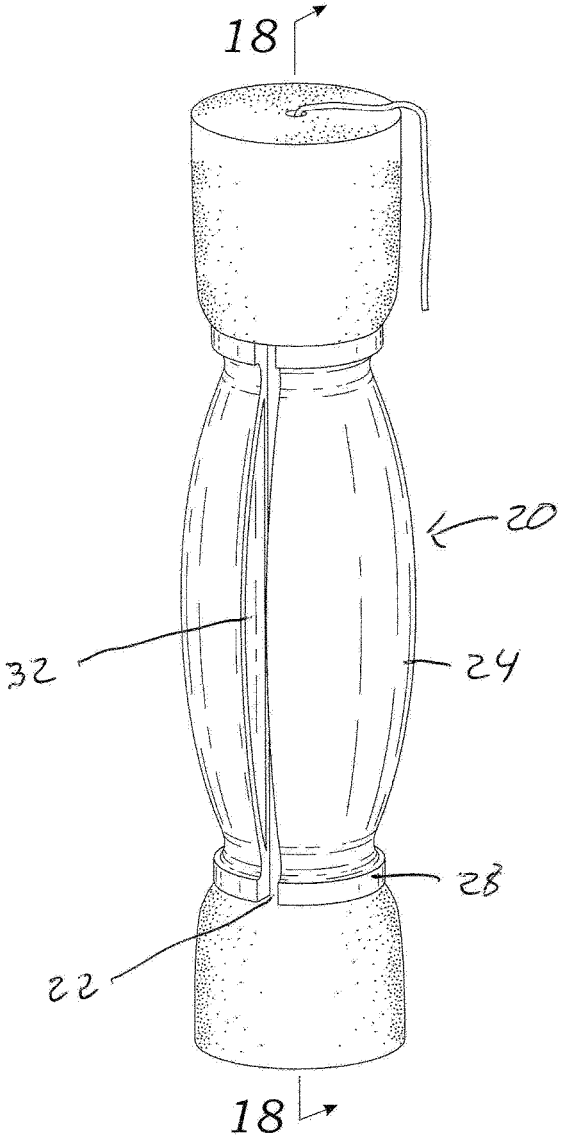
FIG. 17 shows a perspective view of an alternative embodiment of the invention showing an inner barrel having a hallow chamber and said insert has foam on both ends of said insert.
Figure 18:
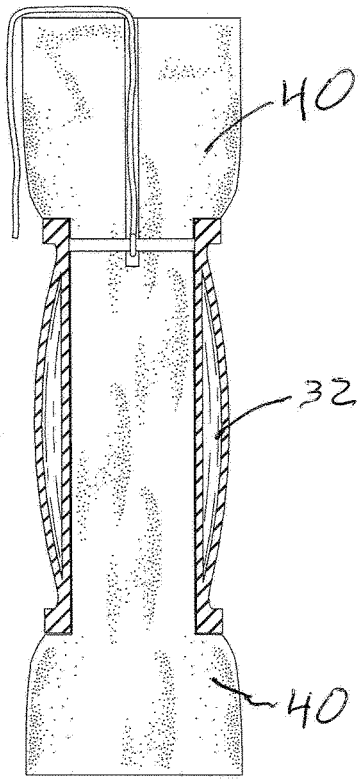
FIG. 18 shows a sectional view of an alternative embodiment of the invention showing an inner barrel insert having foam in and of each ends of said insert.
Figure 19:
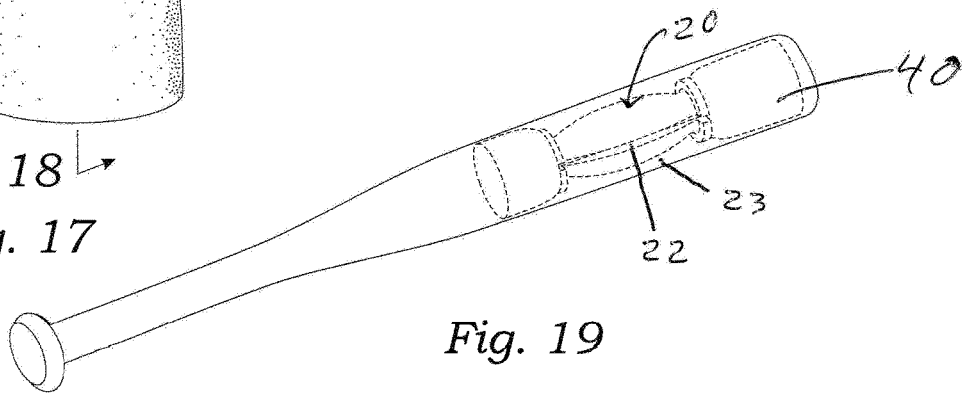
FIG. 19 shows a perspective view of the invention, a bat having one or more inner barrel inserts positioned within the large diameter hitting portion, the inserts each having first and second ends, the inserts each have a vertical gap along the length of the entire inner barrel insert, which forms a "C" when viewing the cross section of the inner barrel insert, which is positioned in the hitting portion to enhance the spring effect as well as enhance the durability of the inner barrel insert.
Figure 20:
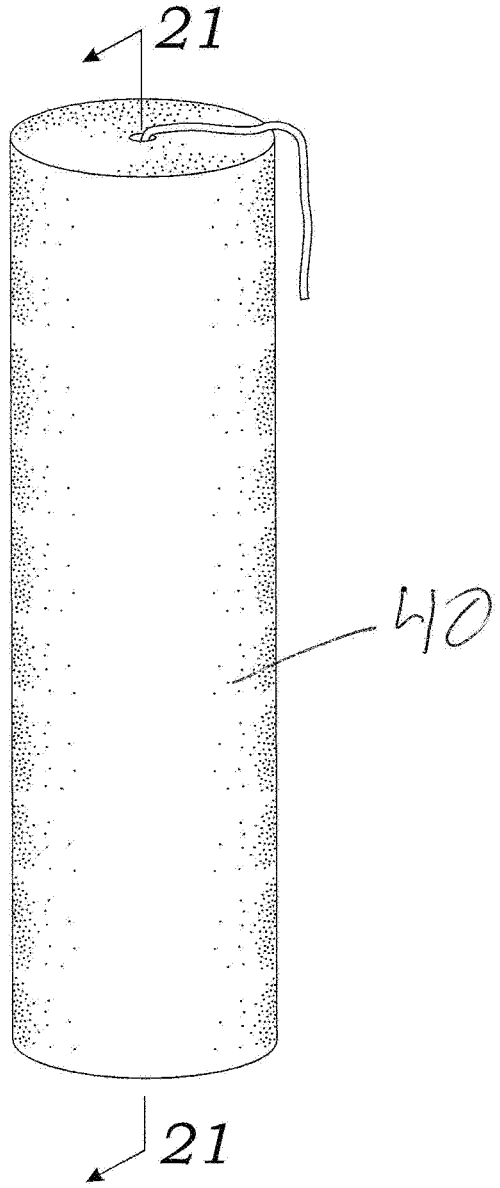
FIG. 20 shows a perspective view of an alternative embodiment of the invention showing an inner barrel contained within foam.
Figure 21:
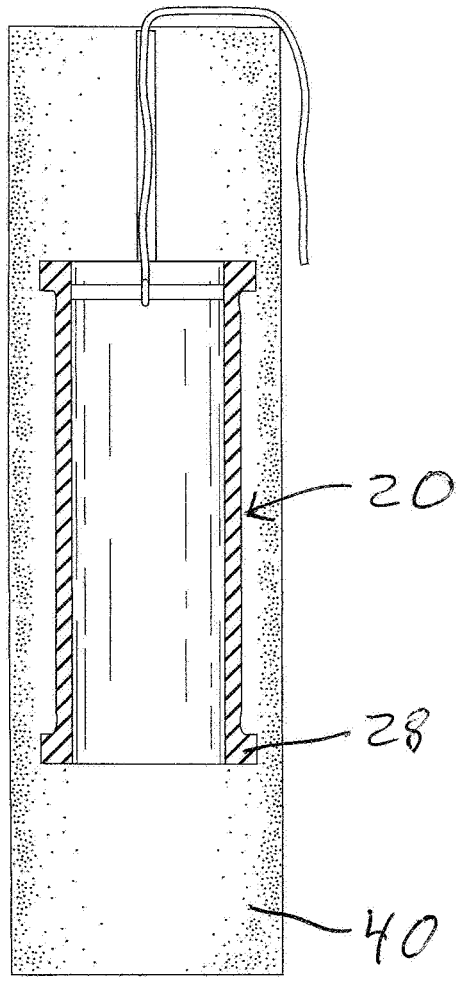
FIG. 21 shows a sectional view of the invention showing an inner barrel insert having foam surround said insert.
Figure 22:
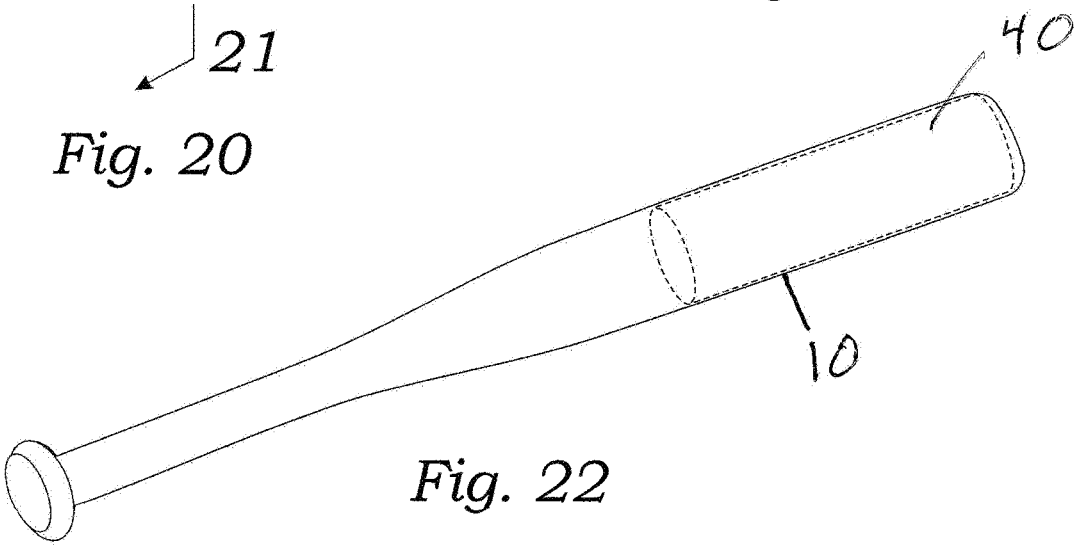
FIG. 22 shows a perspective view of the invention, showing a bat having one or more inner barrel inserts positioned within the large diameter hitting portion, the inserts each having first and second ends, the inserts each have a vertical gap along the length of the entire inner barrel insert, which forms a "C" when viewing the cross section of the inner barrel insert, which is positioned in the hitting portion to enhance the spring effect as well as enhance the durability of the inner barrel insert.
Figure 23:
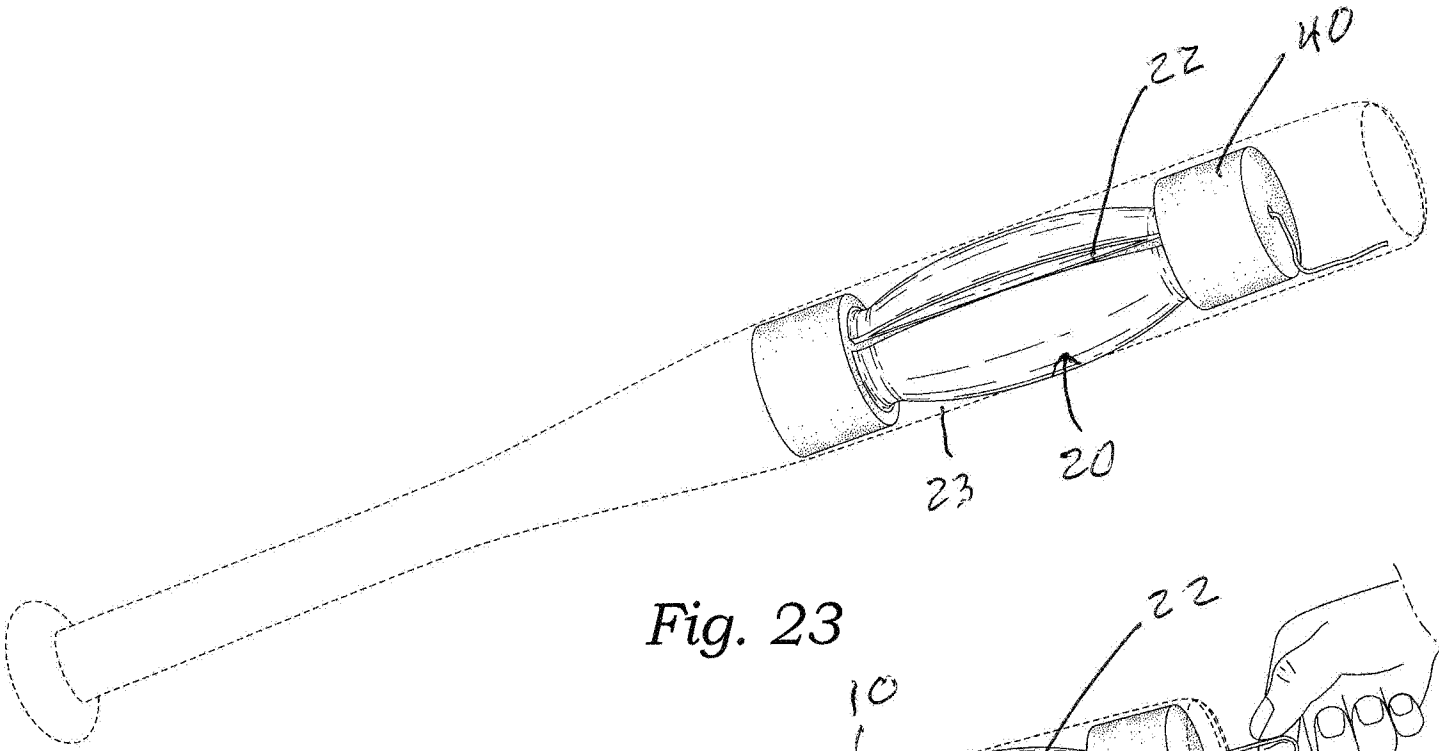
FIG. 23 shows a perspective view of the invention, wherein one or more inner barrel inserts positioned within the large diameter hitting portion, the inserts each having first and second ends with foam positioned on each end and a string attached to one end for adjusting the position of the insert.
Figure 24:
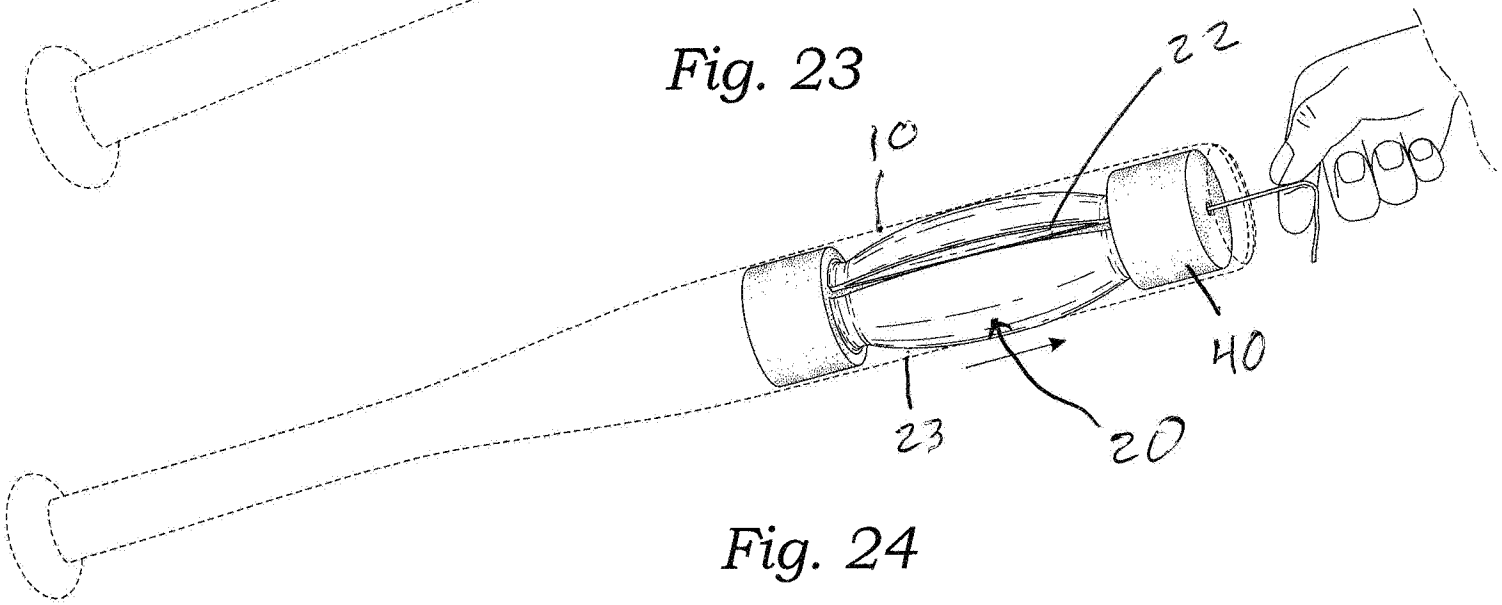
FIG. 24 shows a perspective view of the invention, wherein one or more inner barrel inserts positioned within the large diameter hitting portion, the inserts each having first and second ends with foam positioned on each end and a string attached to one end for adjusting the position of the insert and wherein a user is adjusting the insert.
Figure 25:
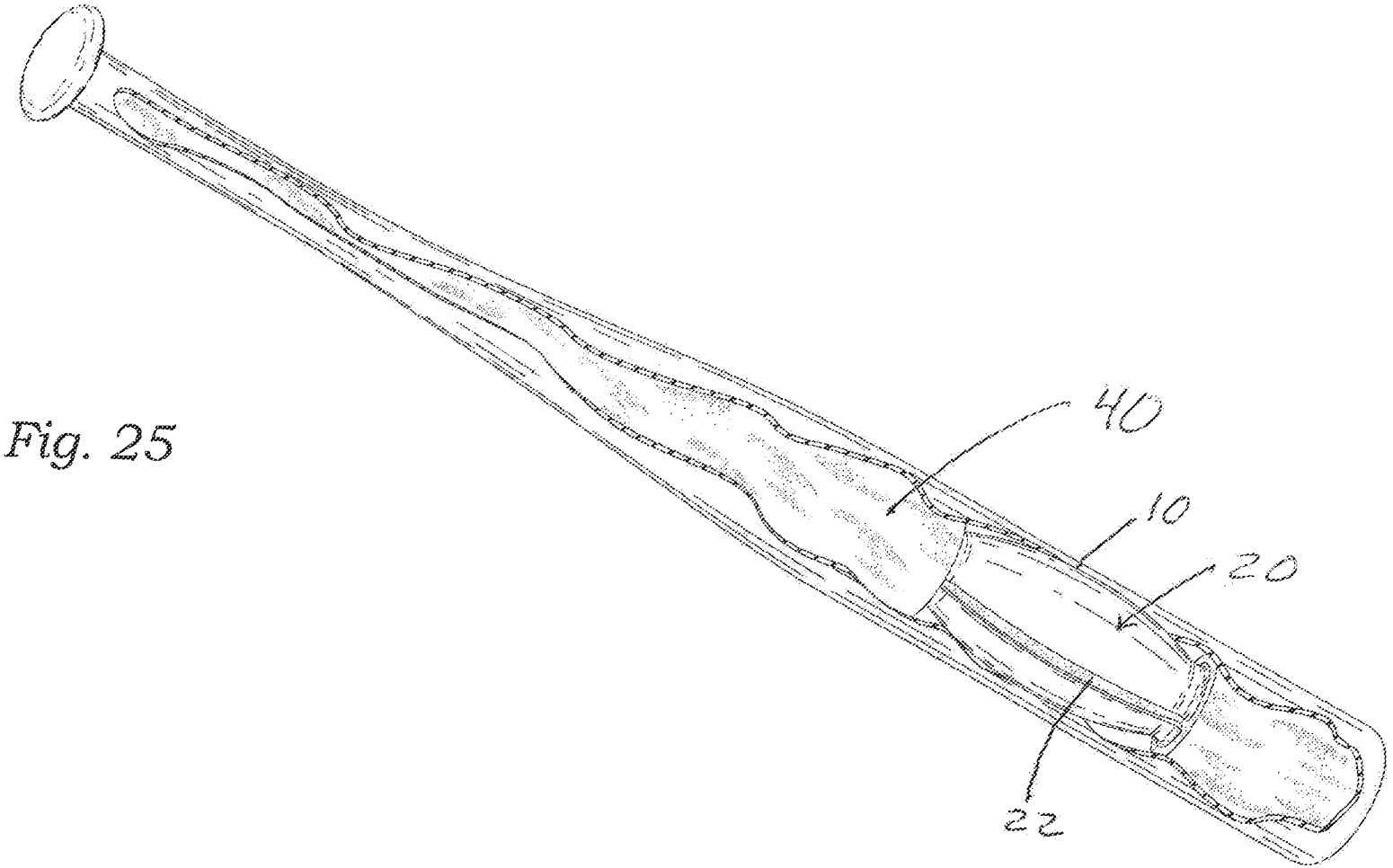
FIG. 25 shows a perspective view of the invention, wherein one or more inner barrel inserts positioned within the large diameter hitting portion, the inserts each having first and second ends, the inserts each have a vertical gap along the length of the entire inner barrel insert, which forms a "C" when viewing the cross section of the inner barrel insert, which is positioned in the hitting portion to enhance the spring effect as well as enhance the durability of the inner barrel insert and wherein foam is insert into the entire length of said bat and in said insert.
Figure 26:
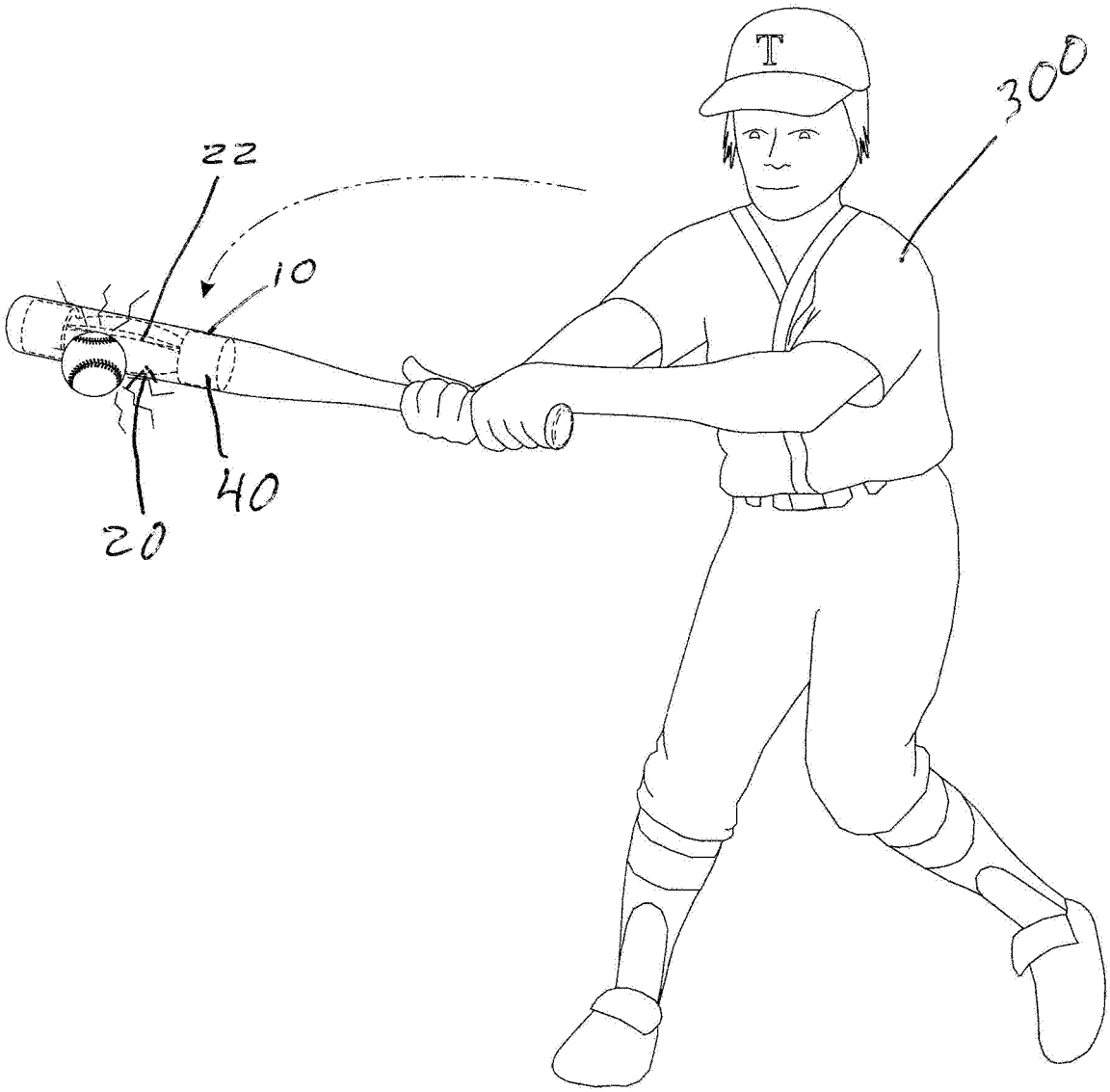
FIG. 26 shows a perspective view of the invention being used by a user, wherein the ball hits the bat having a C shaped spring loaded inner barrel insert having a vertical gap along the length of the entire inner barrel insert positioned at hitting area of the bat.
Figure 27:
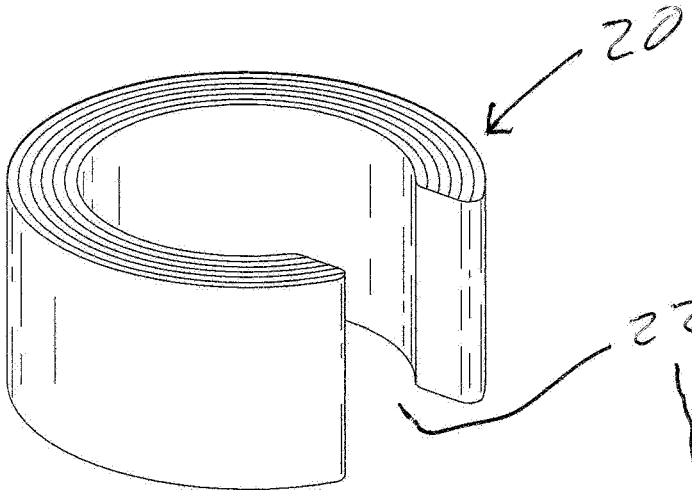
FIG. 27 shows a perspective view of the alternative embodiment of the invention showing a multilayered C shaped spring loaded inner barrel insert having a vertical gap along the length of the entire inner barrel insert of a bat.
Figure 28:
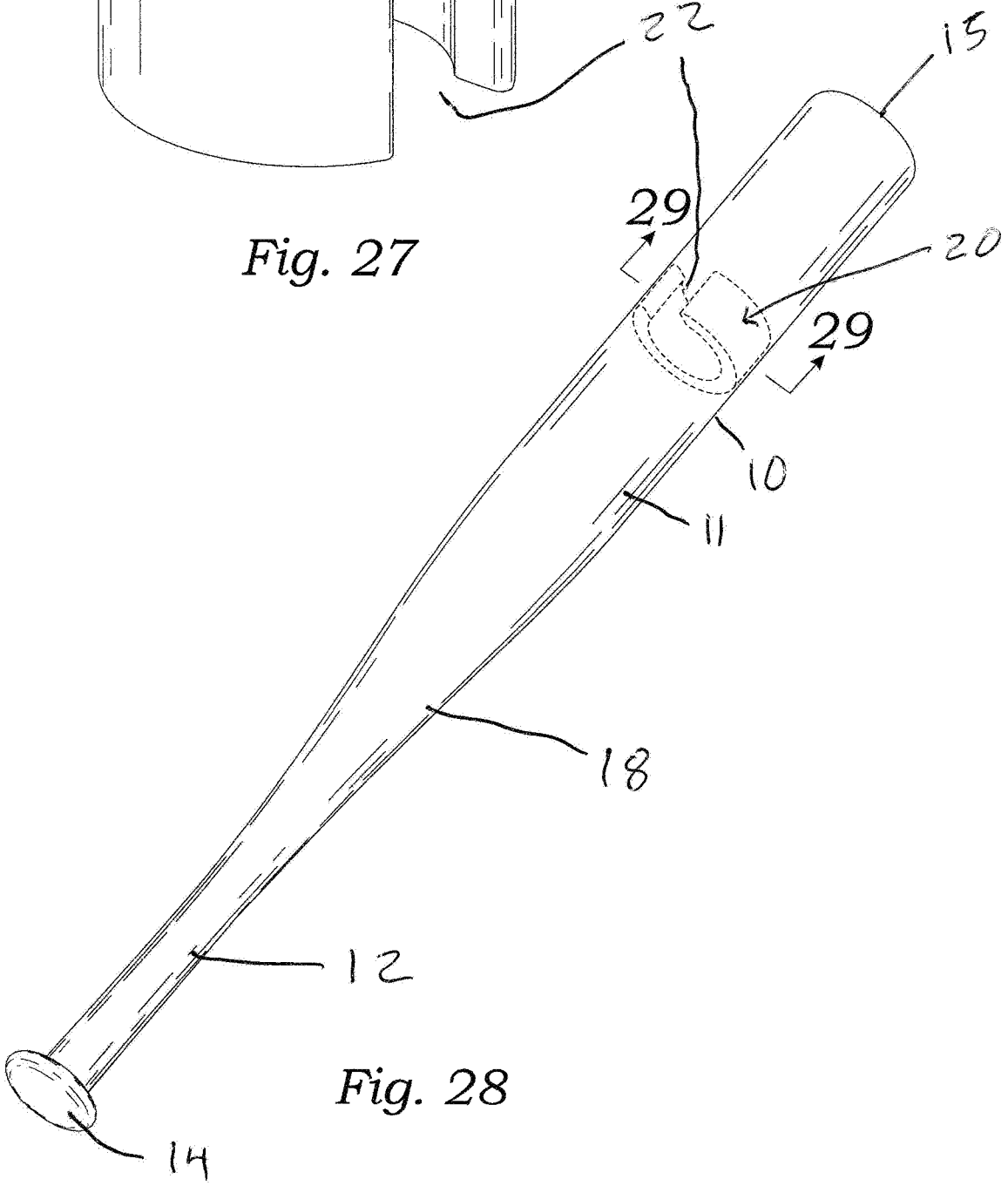
FIG. 28 shows a perspective view of the bat having the spring loaded inner barrel insert positioned in the hitting area of the bat.
Figure 29:
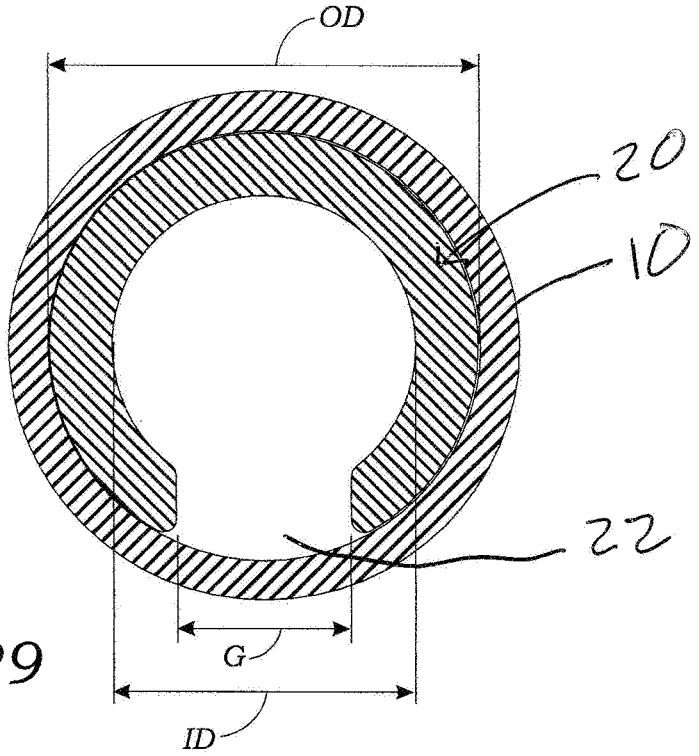
FIG. 29 is a cross section view of the hitting area of the bat showing the bat wall and the C shaped spring loaded inner barrel insert having a vertical gap along the length of the entire inner barrel insert is positioned inside the hitting area of the bat.
Figure 30:
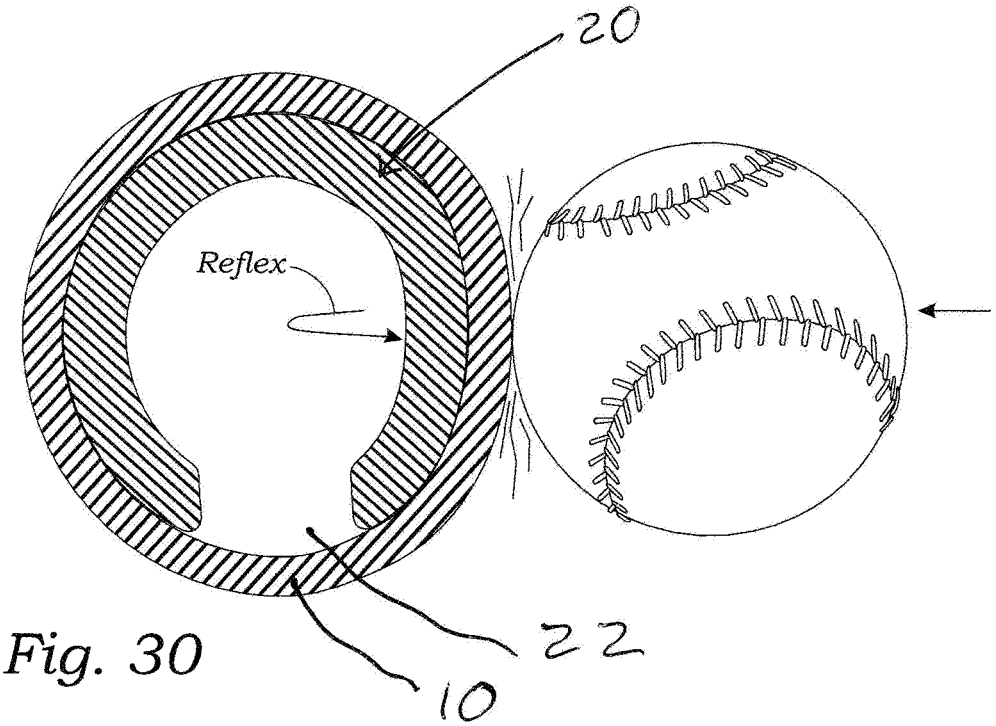
FIG. 30 shows a cross sectional view of the hitting area of the bat showing the bat wall coming into contact with the ball, wherein a C shaped spring loaded inner barrel insert having a vertical gap along the length of the entire inner barrel insert is positioned inside the hitting area of the bat.
Figures 31, 32, 33, 34:
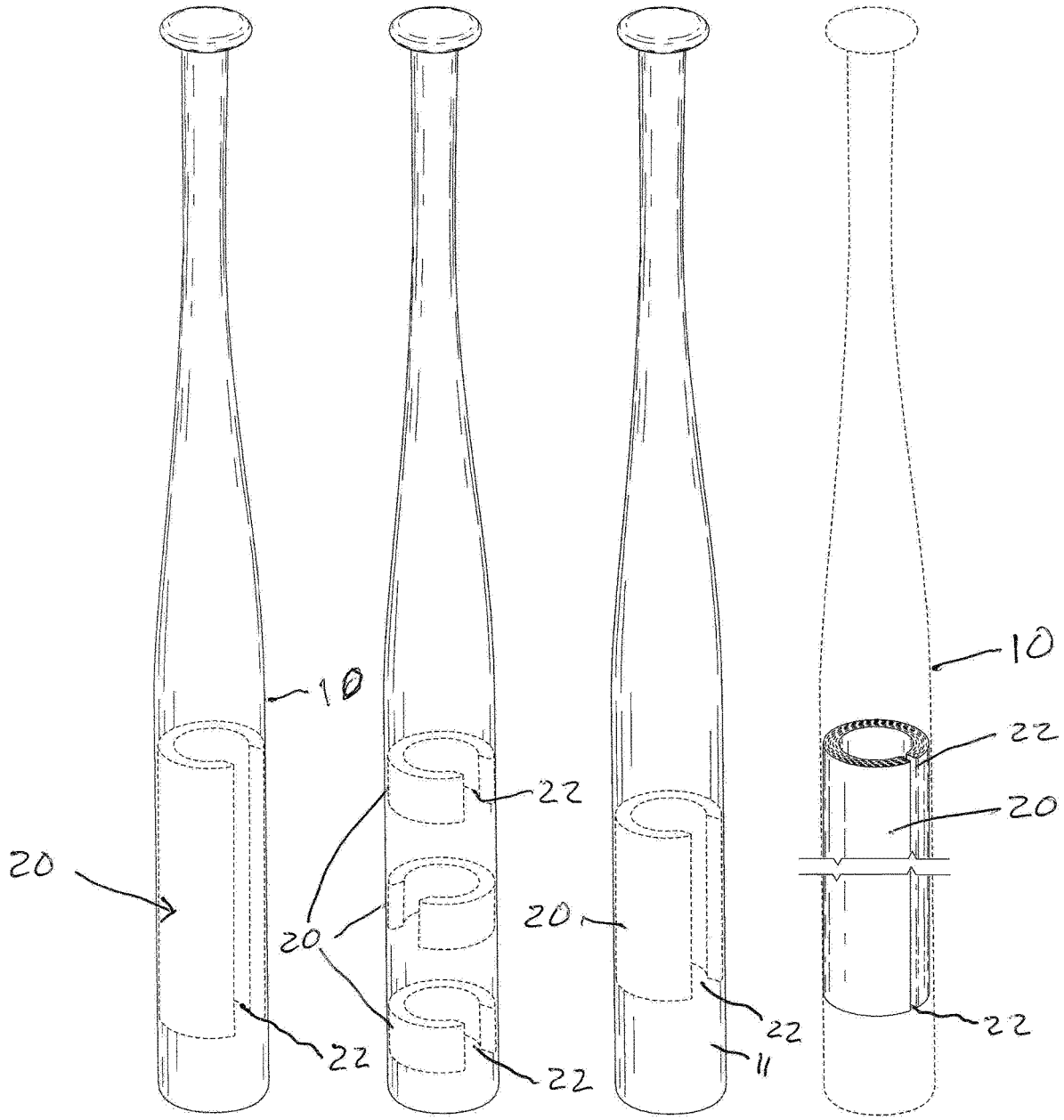
FIG. 31 shows a perspective view of the alternative embodiment of the invention of the bat having a C shaped spring loaded inner barrel insert having a vertical gap along the length of the entire inner barrel insert positioned along the entire hitting area of the bat.
FIG. 32 shows a perspective view of the alternative embodiment of the invention of the bat having one or more C shaped spring loaded inner barrel inserts having a vertical gap along the length of the entire inner barrel insert positioned in the hitting area of the bat.
FIG. 33 shows a perspective view of the alternative embodiment of the invention of the bat having a C shaped spring loaded inner barrel insert having a vertical gap along the length of the entire inner barrel insert positioned in the middle of the hitting area of the bat.
FIG. 34 shows a perspective view of an alternative embodiment of the invention, wherein the bat having a C shaped spring loaded inner barrel insert has a vertical gap along one or more layers, the bat wall and spring loaded inner barrel is positioned inside the hitting area of the bat.
Figure 35:
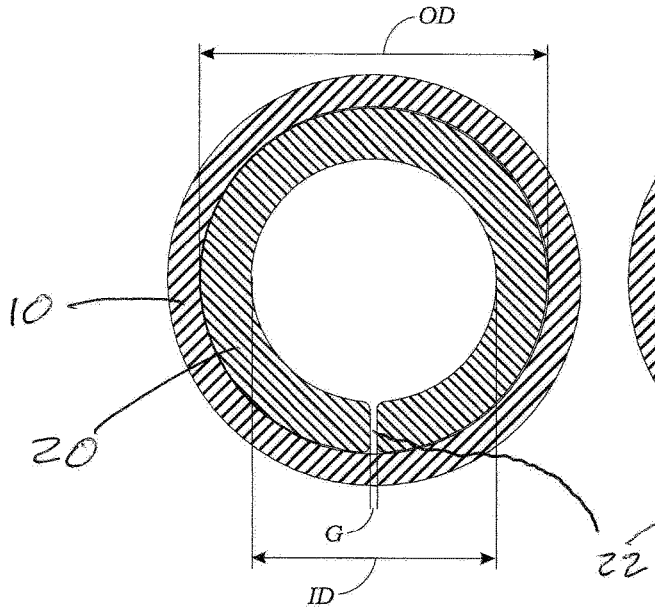
FIG. 35 is a cross section view of the hitting area of the bat showing an alternative embodiment of the invention, wherein a spring loaded inner barrel is not a complete circle and wherein the inner barrel has a small vertical gap along the length of the entire inner barrel insert, the bat wall and a spring loaded inner barrel is positioned inside the hitting area of the bat.
Figure 36:
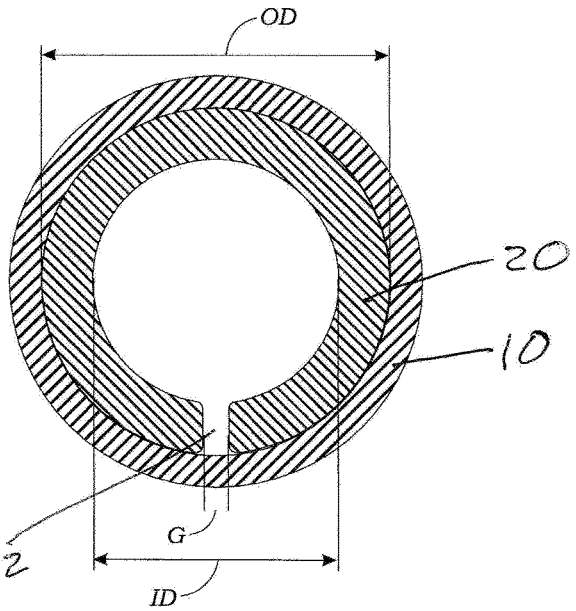
FIG. 36 is an alternative embodiment of a cross section view of the hitting area of the bat showing the bat wall and new inner barrel gap insert, wherein the inner barrel is not a complete circle and in wherein the inner barrel has a larger vertical gap along the length of the entire inner barrel insert and wherein the inner barrel is positioned in the hitting area to enhance the trampoline effect.
Figure 37:
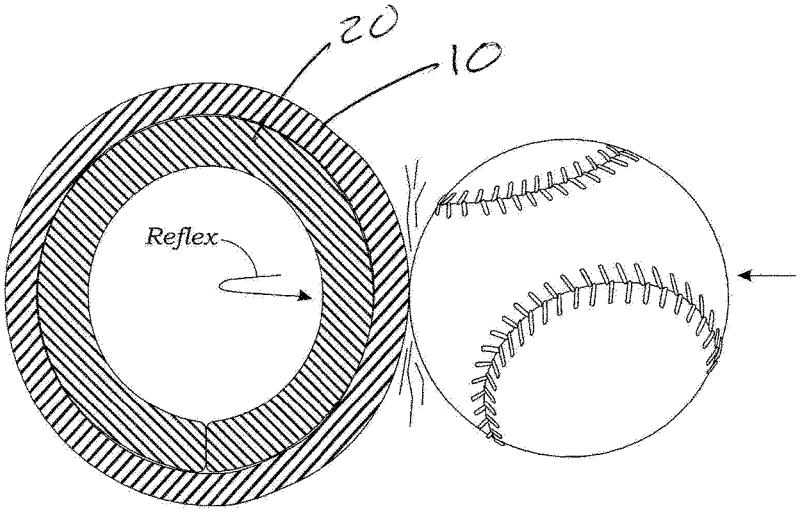
FIG. 37 shows a cross section view of the hitting area of the bat showing the bat wall coming into contact with the ball, wherein a spring loaded inner barrel insert is not a complete circle and wherein the inner barrel insert has a vertical gap, and wherein the spring loaded inner barrel insert is positioned inside the hitting area of the bat.
Figure 38:
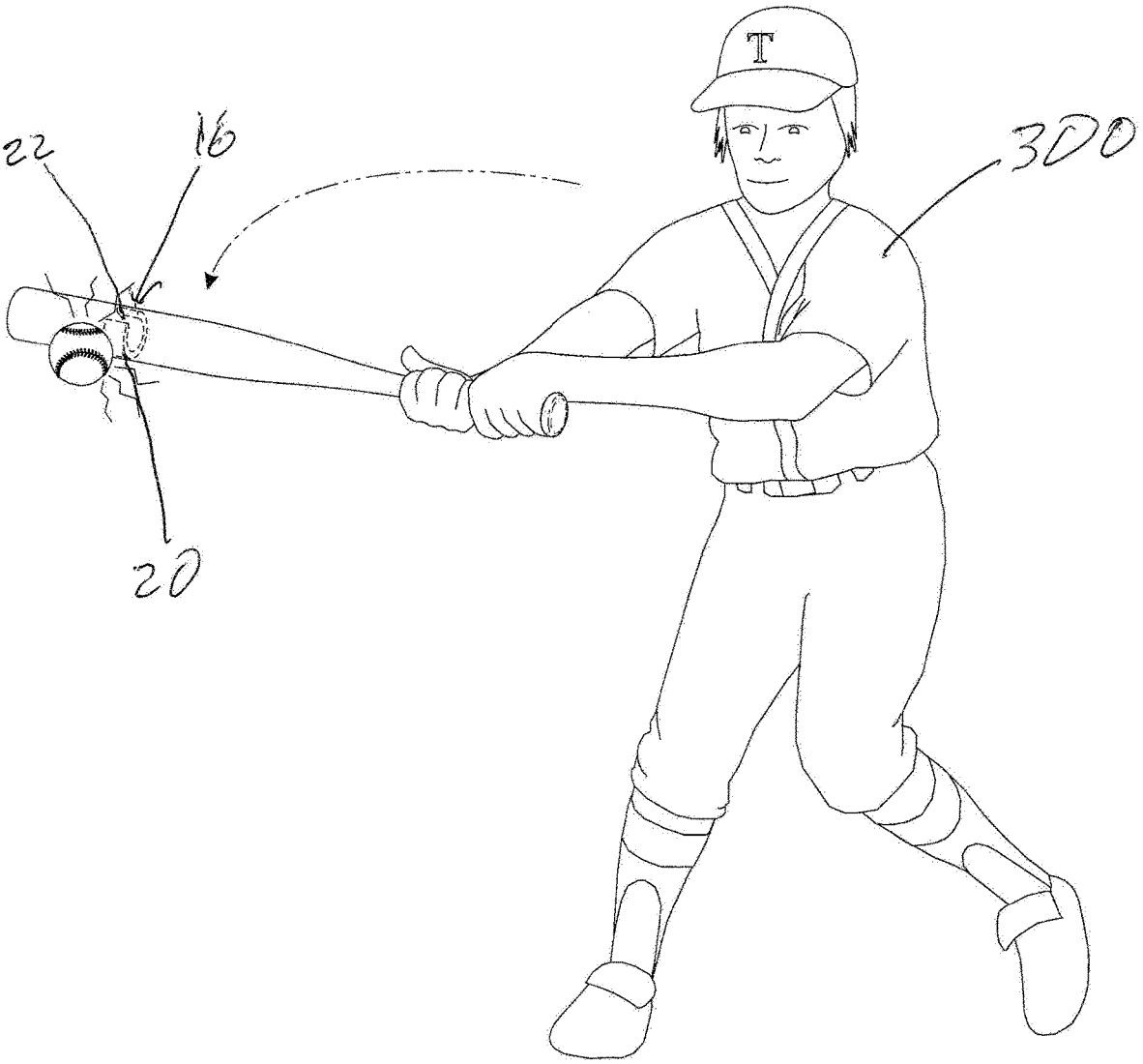
FIG. 38 shows a perspective view of the invention being used by a user, wherein the ball hits the bat having a C shaped spring loaded inner barrel insert positioned at hitting area of the bat.

Referring to FIGS. 1-38 show multiple embodiment of the invention, wherein a spring loaded inner barrel insert is inserted inside the hitting area of a bat.

A bat, comprising: a tubular frame 10 having a circular cross-section, the tubular frame 10 including a large diameter hitting portion 16, an intermediate tapering portion 18, and a small diameter handle portion 12 for a user 300; said tubular frame 10 has a hollow barrel 11 in the large diameter hitting portion 12; one or more inner barrel inserts 20 positioned within the large diameter hitting portion 12, the inserts 20 each having first ends 25 and second ends 26, the inserts each have a vertical gap 22 along the length of the entire inner barrel insert 20, which forms a "C" when viewing the cross section of the inner barrel insert 20, which is positioned in the hitting portion 12 to enhance the spring effect as well as enhance the durability of the inner barrel insert 20; said inner barrel insert 20 being secured within said hitting portion 12; and a cap 15 covering an exposed end of the hitting portion 12.

Wherein said the inner barrel insert 20 has one or more layers.

Wherein said inner barrel insert 20 is relatively convex in shape 24. Wherein said inner barrel insert 20 has a convex outer shape 24. Wherein said inner barrel insert 20 has a convex inner shape 24. Wherein said inner barrel insert 20 has a hallow chamber 32. Wherein said first ends 25 and second ends 26 each have a lip 28 on said inner barrel insert 20.

Further comprising the inner barrel insert 20 being separated from the tubular frame 10 by a void gap 23 along the entire length of the inner barrel insert 20, the void gap 23 being of proportional width relative to the inner barrel insert 20, the void gap 23 having such width so that the inner barrel insert 20 and the tubular frame 10 will elastically deform in conjunction with each other when a baseball is struck.

Further comprising a foam 40 fitted within the inner barrel insert 20, the foam 40 protruding beyond the first end 25 and second ends 26 of the inner barrel insert 20 and expanding beyond first and second ends of the inner barrel insert 20 such that the diameter of the expanded foam 40 is greater than an outer diameter of the inner barrel insert 20, allowing the inner barrel insert 20 to be suspended within the tubular frame 10, to move independently of the tubular frame 10, and to elastically deform in conjunction with the tubular frame 10 when a baseball is struck to improve the rebound effect.

Wherein the foam 40 is adhered to the tubular frame 10 by an adhesive.

Further comprising a foam 40, which is fitted and positioned outside the inner barrel insert 20, allowing the inner barrel insert 20 to be suspended within the tubular frame 10, to move independently of the tubular frame 10, and to elastically deform in conjunction with the tubular frame 10 when a baseball is struck to improve the spring effect.

A bat comprising: a relatively narrow handle portion 12 for gripping by a user 300, a relatively wider distal portion for hitting, and a tapered mid-section 18 connecting the handle 12 and hitting portions 16; the distal portion has a hollow barrel 11 extending from the handle having a wall for impact with a ball; at least one inner barrel insert 20 of minimal weight inserted and retained in the hollow barrel 11 or creating a spring like effect in the hollow barrel 11; and the inner barrel inserts 20 each have a vertical gap 22 along the length of the entire inner barrel insert 20, which forms a "C" when viewing the cross section of the inner barrel insert 20, which enhances the durability of the inner barrel insert 20 and prevents bat fatigue.

Wherein the inner barrel inserts 20 further comprises a plurality of inserts 20. Wherein the inner barrel inserts 20 further comprises inserts 20 of different sizes. Wherein the inner barrel inserts 20 further comprises inserts 20 having different designs. Wherein the inner barrel inserts 20 further comprises inserts that are manufactured from different materials. Wherein the stiffening of the hollow barrel 11 complies with regulatory requirements of a regulatory body.

Wherein said inner barrel insert is relatively convex in shape. Wherein said inner barrel insert has a convex outer shape. Wherein said inner barrel insert has a convex inner shape. Wherein said inner barrel insert has a hallow chamber. Wherein said first and second ends each have a lip on said inner barrel insert.

Further comprising the inner barrel insert being separated from the hollow barrel by a void gap along the entire length of the inner barrel insert, the void gap being of proportional width relative to the inner barrel insert, the void gap having such width so that the inner barrel insert and the hollow barrel will elastically deform in conjunction with each other when a baseball is struck.

Further comprising a foam fitted within the inner barrel insert, the foam protruding beyond the first and second ends of the inner barrel insert and expanding beyond first and second ends of the inner barrel insert such that the diameter of the expanded foam is greater than an outer diameter of the inner barrel insert, allowing the inner barrel insert to be suspended within the hollow barrel, to move independently of the hollow barrel, and to elastically deform in conjunction with the hollow barrel when a baseball is struck to improve the rebound effect.

Further comprising a foam, which is fitted and positioned outside the inner barrel insert, allowing the inner barrel insert to be suspended within the hollow barrel, to move independently of the hollow barrel, and to elastically deform in conjunction with the hollow barrel when a baseball is struck to improve the spring effect.

In which the foam is adhered to the hollow barrel by an adhesive. Wherein the hollow barrel and the at least one inner barrel insert are fused together during manufacturing. Wherein the at least one inner barrel insert is retained using an adhesive bond.

A bat, comprising: a tubular frame having a circular cross-section, the tubular frame including a large diameter hitting portion, an intermediate tapering portion, and a small diameter handle portion for a user; said tubular frame has a hollow barrel in the large diameter hitting portion; one or more inner barrel inserts positioned within the large diameter hitting portion, the inserts each having first and second ends, the inserts each have a vertical gap along the length of the entire inner barrel insert, which forms a "C" when viewing the cross section of the inner barrel insert, which is positioned in the hitting portion to enhance the spring effect as well as enhance the durability of the inner barrel insert; said inner barrel insert is relatively convex in shape; said inner barrel insert being secured within said hitting portion; and a cap covering an exposed end of the hitting portion.

Further comprising the inner barrel insert being separated from the tubular frame by a void gap along the entire length of the inner barrel insert, the void gap being of proportional width relative to the inner barrel insert, the void gap having such width so that the inner barrel insert and the tubular frame will elastically deform in conjunction with each other when a baseball is struck.

Further comprising a foam fitted within the inner barrel insert, the foam protruding beyond the first and second ends of the inner barrel insert and expanding beyond first and second ends of the inner barrel insert such that the diameter of the expanded foam is greater than an outer diameter of the inner barrel insert, allowing the inner barrel insert to be suspended within the tubular frame, to move independently of the tubular frame, and to elastically deform in conjunction with the tubular frame when a baseball is struck to improve the rebound effect.

Further comprising a foam, which is fitted and positioned outside the inner barrel insert, allowing the insert to be suspended within the tubular frame, to move independently of the tubular frame, and to elastically deform in conjunction with the tubular frame when a baseball is struck to improve the spring effect.

In which the foam is adhered to the tubular frame by an adhesive.

Wherein said first and second ends each have a lip on said inner barrel insert.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. The presently disclosed embodiments are therefore to be considered in all respects as illustrative and not restrictive.

I claim:

1. A bat comprising:

a tubular frame having a circular cross-section, the tubular frame including a large diameter hitting portion, an intermediate tapering portion, and a small diameter handle portion for a user;

said tubular frame has a hollow barrel in the large diameter hitting portion;

one or more inner barrel cylindrical inserts positioned within the large diameter hitting portion, the inserts each having first and second ends, the inserts each have a vertical gap along the length of the entire inner barrel cylindrical insert which forms a "C" when viewing the radial cross section of the inner barrel cylindrical insert in place within the barrel so that the inner barrel cylindrical inserts will elastically deform within said tubular frame to close the gap without opposing axial surfaces of the inserts overlapping, the one or more inner barrel cylindrical inserts positioned in the hitting portion of said tubular frame to enhance the spring effect as well as enhance the durability of the inner barrel cylindrical insert;

said one or more inner barrel cylindrical inserts being secured within said hitting portion of said tubular frame with an outer diameter surface of said inner barrel inserts in contact with an inner diameter of said tubular frame;

said one or more inner barrel cylindrical inserts having a combined axial length extending at least one third of an axial length of a hitting area of said hitting portion; and a cap covering an exposed end of the hitting portion of said tubular frame.

2. The bat of claim 1, wherein said handle portion has a knob covering an exposed end of said handle.

3. The bat of claim 1, further comprising the one or more inner barrel cylindrical inserts having two or more part cylindrical layers concentrically positioned and unbonded to each other.

4. A bat comprising:

a relatively narrow handle portion for gripping by a user, a relatively wider distal portion for hitting, and a tapered mid-section connecting the handle and hitting portions;

the distal portion has a hollow barrel extending from the handle having a wall for impact with a ball;

at least one inner barrel insert of minimal weight inserted and retained in the hollow barrel for creating a spring like effect in the hollow barrel; and wherein said at least one inner barrel insert comprises a vertical gap along the length of the entire axial length of said at least one inner barrel insert, whereby said at least one inner barrel insert forms a "C" shape when viewing the radial cross section of the inner barrel insert in place within the barrel so that the inner barrel cylindrical insert will elastically deform within said tubular frame to close the gap without opposing axial surfaces of the insert overlapping, said vertical gap enhancing the durability of the at least one inner barrel insert and prevents bat fatigue, said at least one inner barrel insert has an outer diameter less than an inner diameter of said hitting portion of said frame and extending at least one third of a hitting area of said hitting portion to enhance the spring effect contribution of said at least one inner barrel insert.

5. The bat of claim 4, further comprising a foam attached to said at least one inner barrel cylindrical insert, the foam protruding beyond the first and second ends of the at least one inner barrel cylindrical insert and expanding beyond first and second ends of the inner barrel cylindrical insert such that the diameter of the expanded foam is greater than an outer diameter of the inner barrel cylindrical insert, allowing the inner barrel insert to be suspended within the tubular frame, to move independently of the tubular frame, and to elastically deform in conjunction with the tubular frame when a baseball is struck to improve the rebound effect.

6. The bat of claim 5, in which the foam is adhered to the tubular frame by an adhesive.

7. The bat of claim 5, wherein at least one of said one or more inner barrel cylindrical inserts further comprises first and second ends each having a lip on said at least one inner barrel cylindrical insert.

8. The bat of claim 5, wherein at least one of said one or more inner barrel cylindrical insert has a hollow chamber.

9. The bat of claim 4, wherein the at least one inner barrel insert further comprises a plurality of inserts all having a vertical gap along the length of the entire inner barrel inserts.

10. The bat of claim 4, wherein the at least one inner barrel insert further comprises inserts of different lengths all having a vertical gap along the length of the entire inner barrel insert.

11. A bat, comprising:

a tubular frame having a circular cross-section, the tubular frame including a large diameter hitting portion, an intermediate tapering portion, and a small diameter handle portion for a user;

said tubular frame has a hollow barrel in the large diameter hitting portion; a first inner barrel insert positioned within the large diameter hitting portion, the first inner barrel insert having first and second ends, a vertical gap along the axial length of said first inner barrel insert which forms a "C" when viewing the radial cross section of the first inner barrel insert in place within the barrel so that the inner barrel cylindrical insert will elastically deform within said tubular frame to close the gap without opposing axial surfaces of the insert overlapping, said first inner barrel insert is positioned in the hitting portion to enhance the spring effect as well as enhance the durability of the first inner barrel insert and said hitting portion of said frame;

said inner barrel insert having an outer diameter less than an inner diameter of said hitting portion of said frame;

said first inner barrel insert being positioned within at least one inch of said hitting portion; and a cap covering an exposed end of the hitting portion.

12. The bat according to claim 11, further comprising a second inner barrel insert having a vertical gap along the axial length of said second inner barrel insert which forms a "C" when viewing the radial cross section of the second inner barrel insert in place within the barrel so that the second inner barrel insert will elastically deform within said tubular frame to close the gap without opposing axial surfaces of the insert overlapping, the second inner barrel insert being separated from the tubular frame by a void gap along the entire length of the second inner barrel insert, the void gap being of proportional width relative to the second inner barrel insert, the void gap having such width so that the second inner barrel insert and the tubular frame will elastically deform in conjunction with each other when a baseball is struck.

13. The bat according to claim 11, further comprising a foam fitted within the inner barrel insert, the foam protruding beyond the first and second ends of the inner barrel insert and expanding beyond first and second ends of the inner barrel insert such that the diameter of the expanded foam is greater than an outer diameter of the inner barrel insert, allowing the inner barrel insert to be suspended within the tubular frame, to move independently of the tubular frame, and to elastically deform in conjunction with the tubular frame when a baseball is struck to improve the rebound effect.

* * * * *